US009357324B2

(12) United States Patent
Par

(10) Patent No.: US 9,357,324 B2
(45) Date of Patent: May 31, 2016

(54) DEVICE AND METHOD FOR OPTIMIZING STEREOPHONIC OR PSEUDO-STEREOPHONIC AUDIO SIGNALS

(75) Inventor: Clemens Par, Cinuos-chel (CH)

(73) Assignee: STORMINGSWISS GMBH, Morges (CH)

( * ) Notice: Subject to any disclaimer, the term of this patent is extended or adjusted under 35 U.S.C. 154(b) by 236 days.

(21) Appl. No.: 13/352,572

(22) Filed: Jan. 18, 2012

(65) Prior Publication Data

US 2012/0134500 A1 May 31, 2012

Related U.S. Application Data

(63) Continuation of application No. PCT/EP2010/055877, filed on Apr. 29, 2010.

(30) Foreign Application Priority Data

Jul. 22, 2009 (CH) ..... 2009-1159
Nov. 18, 2009 (CH) ..... 2009-1776

(51) Int. Cl.
*H04R 5/00* (2006.01)
*H04S 5/00* (2006.01)

(52) U.S. Cl.
CPC ..... *H04S 5/00* (2013.01)

(58) Field of Classification Search
CPC ..... H04S 5/00; H04S 5/02
USPC ..... 381/17, 20, 21, 22
See application file for complete search history.

(56) References Cited

U.S. PATENT DOCUMENTS

| | | | |
|---|---|---|---|
| 5,173,944 | A | 12/1992 | Begault |
| 5,235,646 | A | 8/1993 | Wilde et al. |
| 5,579,395 | A | 11/1996 | Horl |
| 5,671,287 | A | 9/1997 | Gerzon |
| 6,111,958 | A | 8/2000 | Maher |
| 6,636,608 | B1 | 10/2003 | Kishii et al. |

(Continued)

FOREIGN PATENT DOCUMENTS

| | | | |
|---|---|---|---|
| EP | 0643899 | B1 | 3/1996 |
| EP | 0825800 | A2 | 2/1998 |

(Continued)

OTHER PUBLICATIONS

International Search Report for PCT/EP2010/055877 dated Aug. 5, 2010.

*Primary Examiner* — Alexander Jamal
(74) *Attorney, Agent, or Firm* — Pearne & Gordon LLP

(57) ABSTRACT

The invention permits optimum choice of those parameters which form the basis for the generation of stereophonic or pseudo-stereophonic signals. The user is provided with means for stipulating the degree of correlation, the definition range, the loudness and also further parameters of the resulting signals according to psychoacoustic aspects, and hence for preventing artifacts.

The invention can be used to define highly efficient encoders or decoders which confine audio signals intended for reproduction by two or more than two loudspeakers as a mono signal plus a few parameters.

Specific areas of application are telecommunications (hands-free devices), global networks, computer systems, broadcasting and transmission devices, particularly satellite transmission devices, professional audio technology, television, film and broadcasting and also electronic consumer goods.

34 Claims, 14 Drawing Sheets

(56) References Cited

U.S. PATENT DOCUMENTS

| | | | | |
|---|---|---|---|---|
| 8,526,623 | B2 * | 9/2013 | Franck et al. | 381/17 |
| 2003/0039365 | A1 * | 2/2003 | Eid et al. | 381/27 |
| 2006/0115100 | A1 * | 6/2006 | Faller | 381/119 |
| 2008/0267413 | A1 * | 10/2008 | Faller | 381/1 |

FOREIGN PATENT DOCUMENTS

| | | | |
|---|---|---|---|
| EP | 1850639 | A1 | 10/2007 |
| EP | 2124486 | A1 | 11/2009 |

* cited by examiner

DEVICE AND METHOD FOR OPTIMIZING STEREOPHONIC OR PSEUDO-STEREOPHONIC AUDIO SIGNALS

The present application is a continuation of international application PCT/EP2010/055877, the contents of which is hereby incorporated by reference. It claims priority from Swiss patent application CH2009/1159 filed on Jul. 22, 2009, the contents of which is hereby incorporated by reference, and of Swiss patent application CH2009/1776 filed on Nov. 18, 2009, the contents of which is hereby incorporated by reference.

The invention relates to audio signals and apparatuses or methods for the generation, transmission, conversion and reproduction thereof.

It is general knowledge that audio signals which are emitted via two or more loudspeakers provide the listener with a spatial impression, provided that they show different amplitudes, frequencies, time or phase differences or are reverberated appropriately.

Such decorrelated signals can firstly be generated by differently positioned sound transducer systems, the signals from which are optionally postprocessed, or can be generated by means of what are known as pseudo-stereophonic techniques, which produce such suitable decorrelation—on the basis of a mono signal.

EP2124486 and EP1850639 describe, by way of example, a method for methodically evaluating the angle of incidence for the sound event that is to be mapped, said angle of incidence being enclosed by the main axis of the microphone and the directional axis for the sound source, this being achieved by applying time differences and amplitude corrections which are functionally dependent on the original recording situation (which may be interpolated by using the system). The content of EP2124486 and of EP1850639 is hereby introduced as a reference.

EP0825800 (Thomson Brandt GmbH) proposes the formation of different kinds of signals from a mono input signal by means of filtering, which signals are used—for example by using a method proposed by Lauridsen based on amplitude and time difference corrections, depending on the recording situation—to generate virtual single-band stereo signals separately, these subsequently being combined to form two output signals.

U.S. Pat. No. 5,173,944 (Begault Durand) applies HRTFs (Head Related Transfer Functions) which correlate with 90, 120, 240 and 270 degrees azimuth, respectively, to the varyingly delayed but uniformly amplified monophonic input signal, the signals formed in turn finally being superimposed on the original mono signal. In this case, the amplitude correction and the time difference corrections are chosen independently of the recording situation.

The earlier patent application CH01159/09 on behalf of the patent applicant (filed on Jul. 22, 2009) proposes the ostensibly not purposeful downstream connection of one or more panoramic potentiometers or equivalent means in an apparatus according to EP2124486 or EP1850639 after MS matrixing has taken place (after an MS matrix, for which the relation $$L=(M+S)*1/\sqrt{2}$$

and $$R=(M-S)*1/\sqrt{2}$$

applies, has been passed through), which do not—as in the case of intensity stereophonic signals, that is to say for stereo signals which differ exclusively in terms of their levels but not in terms of time or phase differences or different frequency spectra—result in the intended narrowing of the mapping width or the intended shifting of the mapping direction of the obtained stereo signals, but instead rather result in the degree of correlation being increased or lowered.

In the case of the configuration according to EP2124486, according to EP1850639 and/or according to CH01159/09, different parameters may be chosen in the stereo converter which are used to generate pseudo-stereophonic signals. Though often plural parameters or plural sets of parameters may be used to in order to obtain pseudo-stereophonic audio signals, the choice of such parameters has an impact on the perceived spatial sound image. The choice of the parameters which are optimum in a certain condition or for a particular audio signal is not trivial, however.

Furthermore, the adjustment of the parameters also frequently has an impact on the degree of correlation between the left channel and the right channel. As part of the invention, however, it has been found that it would make sense to stipulate a uniform degree of correlation for the evaluation of different parameterizations for $\phi$ or f (or, respectively, the simplifying parameter n), $\alpha$, $\beta$.

It therefore is an aim of the present invention to provide a new method and a new apparatus for obtaining pseudo-stereophonic signals.

It is, in particular, an aim to provide a new method and a new apparatus for automatically and optimally choosing such parameters which form the basis for the generation of stereophonic or pseudo-stereophonic signals.

It is also an aim to provide a method and an apparatus for optimally and automatically determining particularly the parameters ($\phi$, $\lambda$, $\rho$ or f (or, respectively, n), $\alpha$, $\beta$) while generating said stereophonic or pseudo-stereophonic signals.

Said method and said apparatus are intended to be used to select, from a plurality of decorrelated, in particular pseudo-stereophonic, signal variants, those whose decorrelation is found to be particularly beneficial.

In particular, the selection criteria themselves are intended to be able to be influenced in an as efficient and compact a form as possible in order to be able to convert signals of different nature (for example speech in contrast to music recordings) into the optimized reproduction thereof.

According to one aspect, an apparatus and a method for obtaining pseudo-stereophonic output signals x(t) and y(t) by using an MS matrix are therefore proposed, wherein x(t) is the function value of the resulting left output channel at the time t, and y(t) is the function value of the resulting right output channel at the time t, in which the obtainment is iteratively optimized until <x(t), y(t)> is within a predetermined definition range.

If there are dropouts or similar defects, however, there may be an insignificant quantity of single points outside of the definition range. In this case, the obtainment is iteratively optimized until a portion of <x(t), y(t)> is within the predetermined definition range. Since this portion usually differs from the whole only insignificantly on account of dropouts or similar defects, this apparatus must also be covered as equivalent by the scope of protection of the patent claims.

The desired definition range is preferably stipulated by a single numerical parameter a, where preferably $0 \le a \le 1$. This parameter and hence the definition range can be usefully stipulated by the inequalities $$|Re\{f^*[x(t)]+g^*[y(t)]\}| \le |a^* \cos arg\{f^*[x(t)]+g^*[y(t)]\}|$$

and $$|Im\{f^*[x(t)]+g^*[y(t)]\}| \le \sin arg\{f^*[x(t)]+g^*[y(t)]\}|,$$

for example, with the relations $$f^*[x(t)]=[x(t)/\sqrt{2}]^*(-1+i)$$

and $$g^*[y(t)]=[y(t)/\sqrt{2}]^*(1+i)$$

applying for the complex transfer functions f*[x(t)] and g*[y(t)] of the output signal x(t), y(t).

A person skilled in the art would, by way of example, also advantageously stipulate such a parameter a or, respectively, such a definition range by means of the inequality $$Re^2\{f^*[x(t]+g^*[y(t)]\}^*1/a^2+Im^2\{f^*[x(t)]+g^*[y(t)]\}\leq 1,$$

where f*[x(t)] and g*[y(t)] are again the above complex transfer functions of the output signal x(t), y(t), and $0\leq a\leq 1$ is true.

In both cases, the user can arbitrarily stipulate such a definition range, on the basis of the unit circle of the complex number plane or of the imaginary axis (if the maximum level of the output signal x(t), y(t) has been normalized on the unit circle), by using the parameter a, $0\leq a\leq 1$.

This principle, explained by using two examples, also remains valid when a reference system other than the unit circle of the complex number plane is chosen and a different new definition range is defined. "Definition range" is therefore understood generally to mean an admissible range of values for <x(t), y(t)> of the output signal x(t), y(t), which, overall, is intended to contain <x(t), y(t)> in full or in part (for example in the case of defective sound recordings which show what are known as dropouts).

In one preferred variant, the degree of correlation of the output signals (x(t) and y(t)) is normalized. In one preferred variant, the level of the maximum of the resulting left channel and of the resulting right channel is normalized. In this way, certain parameters can be iteratively optimized in order to attain the desired definition range, without said parameters influencing the degree of correlation or the level of the maximum of the resulting left channel and of the resulting right channel.

It also makes sense if—for extremely different parameterizations for ϕ or f (or, respectively, n), α, β—criteria which are dependent on |<x(t), y(t)>| are used for stipulation. For this purpose, the invention therefore involves a corresponding range of values which is dependent on |<x(t), y(t)>|, such range of values being normalized, so as to be a criterion for the optimization of the parameters.

In one embodiment, a method for obtaining pseudo-stereophonic output signals x(t) and y(t) by using a converter is therefore proposed, wherein x(t) is the function value of the resulting left output channel at the time t, wherein y(t) is the function value of the resulting right output channel at the time t, wherein the complex transfer functions f*[x(t)] and g*[y(t)] of the output signals are defined:

$$f^*[x(t)]=[x(t)/\sqrt{2}]^*(-1+i)$$

$$g^*[y(t)]=[y(t)/\sqrt{2}]^*(1+i)$$

in which the obtainment is iteratively optimized until the following criteria are satisfied:

$$|Re\{f^*[x(t)]+g^*[y(t)]\}|\leq|a^*\cos arg\{f^*[x(t)]+g^*[y(t)]\}|,$$

where $0\leq a\leq 1$ stipulates the desired definition range, and $$|Im\{f^*[x(t)]+g^*[y(t)]\}|\leq|\sin arg\{f^*[x(t)]+g^*[y(t)]\}|.$$

In another embodiment, a person skilled in the art would advantageously replace these criteria with the criterion $$Re^2\{f^*[x(t]+g^*[y(t)]\}^*1/a^2+Im^2\{f^*[x(t)]+g^*[y(t)]\}\leq 1.$$

A remarkable aspect of the methods for obtaining pseudo-stereophonic signals according to EP2124486 or according to EP1850639 is the fact that they always provide a perfect middle signal. For this reason, the short-time cross correlation $$r=(1/2T)*\int_{-T}^{T}x(t)y(t)dt*\left(1/x(t)_{eff}\,y(t)_{eff}\right) \quad (1)$$

is introduced here for the time interval [−T, T] and the output signals x(t) from the left channel and y(t) from the right channel.

As already mentioned, it makes sense if a uniform degree of correlation is attained for extremely different parameterizations for ϕ or f (or, respectively, n), α, β. For this purpose, the invention therefore involves the degree of correlation between the output signals (x(t) and y(t)) being normalized. This normalization can preferably be stipulated by means of the specific variation of λ (left attenuation) or ρ (right attenuation).

On the basis of the uniform degree of correlation, the signal attained can now be systematically subjected to evaluation criteria which can be influenced by the user.

It also makes sense if a uniform level for the maximum of the resulting left channel and of the resulting right channel is being attained for extremely different parameterizations for ϕ or f (or, respectively, n), α, β. For this purpose, the invention therefore involves the level of the maximum of the resulting left channel and of the resulting right channel being normalized, as a result of which this level is not influenced by the optimization of the parameters.

By way of example, it makes sense for, initially, the modulation for the maximum of the left signal L and of the right signal R to be uniformly confined to 0 dB, for example, by means of a first logic element.

It also makes sense if—for extremely different parameterizations for ϕ or f (or, respectively, n), α, β—criteria which are dependent on <x(t), y(t)> or on |<x(t), y(t)>| are used for stipulation. For this purpose, the invention therefore involves a respective corresponding range of values which is normalized, so as to be a criterion for the optimization of the parameters.

x(t) and y(t) are mapped within the unit circle of the complex number plane. The function f*[x(t)]+g*[y(t)] can now be analyzed in more detail in order to draw conclusions concerning the quality of the respective output signal from an apparatus according to EP2124486 or EP1850639, for example. Any decorrelation between the two signals f*[x(t)] and g*[y(t)] is in this case equivalent to a deflection on the real axis when analyzing the function f*[x(t)]+g*[y(t)].

The stereo converter is therefore optimized according to the cited criteria for |Re{f*[x(t)]+g*[y(t)]}| and for |Im{f*[x(t)]+g*[y(t)]}|, for example.

This method is found to be particularly beneficial, since a single parameter, namely a, takes optimum account of, in particular, the different nature of the output signals from an apparatus or a method according to EP2124486 or EP1850639. The parameter may preferably be dependent on the type of the audio signal, for example in order to process speech or music differently on a manual or automatic basis. In the case of speech, unlike music recordings, the definition range determined by a preferably needs to be restricted significantly due to disturbing artifacts such as high-frequency sidetone during the articulation.

In addition, given limitation to a single parameter a, any optimum mapping range can be chosen for f*[x(t)]+g*[y(t)] based on the unit circle or the imaginary axis.

If the signals x(t), y(t) do not satisfy the aforementioned constraints, the invention involves optimization being carried out by redetermining the parameters $\phi$ or f (or, respectively, n) or $\alpha$ or $\beta$—according to an iterative procedure that is matched with the function values x[t($\phi$, f, $\alpha$, $\beta$)] and y(t($\phi$, f, $\alpha$, $\beta$)] or, respectively, x[t($\phi$, n, $\alpha$, $\beta$)] and y[t($\phi$, n, $\alpha$, $\beta$)]—whilst executing steps presented hitherto until x(t) and y(t) meet the aforementioned constraints.

In a further step, by way of example, the relief of the function f*[x(t)]+g*[y(t)] is now analyzed for the purpose of maximizing the function values thereof. It is possible to show that this procedure is equivalent to the maximization of $$\int_{-T}^{T} |f^*[x(t)] + g^*[y(t)]| dt; \tag{6}$$

this expression, for its part, remains less than or equal to the value of $$\int_{-T}^{T} |a * \cos\arg\{f^*[x(t)] + g^*[y(t)]\} + i * \sin\arg\{f^*[x(t)] + g^*[y(t)]\}| dt \tag{7}$$

By way of example, a person skilled in the art would also advantageously replace (7) with $$\int_{-T}^{T} a * \{1/\sqrt{[1-(1-a^2) * \sin^2\arg\{f^*[x(t)] + g^*[y(t)]\}]}\} dt. \tag{7a}$$

In this case too, the user is provided with a tool in so far as he has a free choice of the limit value R* (or the deviation $\Delta$ defined by the inequality (8), see below) for this maximization within the context of (8). Overall, the following constraint must be met for the total number of possible signal variants $x_j(t)$, $y_j(t)$:

$$\begin{aligned} 0 \le R^* - \Delta \le \int_{-T}^{T} |f^*[x(t)] + g^*[y(t)]| dt \le \max\{f^*[x_j(t)], g^*[y_j(t)]\} \in \\ \Phi \int_{-T}^{T} |f^*[x_j(t)] + g^*[y_j(t)]| dt \le R^* + \Delta \le \\ \int_{-T}^{T} |a * \cos\arg\{f^*[x(t)] + g^*[y(t)]\} + \\ i * \sin\arg\{f^*[x(t)] + g^*[y(t)]\}| dt. \end{aligned} \tag{8}$$

A person skilled in the art would in turn advantageously replace (8) with $$\begin{aligned} 0 \le R^* - \Delta \le \int_{-T}^{T} |f^*[x(t)] + g^*[y(t)]| dt \le \max\{f^*[x_j(t)], g^*[y_j(t)]\} \in \\ \Phi \int_{-T}^{T} |f^*[x_j(t)] + g^*[y_j(t)]| dt \le R^* + \Delta \le \end{aligned} \tag{8a}$$

-continued $$\int_{-T}^{T} a * \{1/\sqrt{[1-(1-a^2) * \sin^2\arg\{f^*[x(t)] + g^*[y(t)]\}]}\} dt$$

R* and $\Delta$ are directly related to the loudness of the output signal that is to be attained (that is to say to those parameters which the listener also takes as a basis for assessing the validity of a stereophonic map).

If the neighborhood of the limit value R*, defined by $\Delta$, or the maximum of all possible integrated reliefs is not reached, optimization, with a view to the limit value R* and the deviation $\Delta$ or to the aforementioned maximum—in accordance with an iterative procedure that is matched with the function values x[t($\phi$, f, $\alpha$, R)] and y[t($\phi$, f, $\alpha$, R)] or, respectively, x[t($\phi$, n, $\alpha$, $\beta$)] and y[t($\phi$, n, $\alpha$, $\beta$)]—, involves new parameters $\phi$ or f or $\alpha$ or $\beta$ being determined, and whilst executing all steps illustrated hitherto until signals x(t), y(t) or parameters $\phi$ or $\lambda$ or $\rho$ or f (or, respectively, n) or $\alpha$ or $\beta$ result, which correspond to optimum stereophonization.

With an appropriate choice of degree of correlation r, of parameter a—stipulating the desired respective definition range—and of limit value R* and also deviation $\Delta$ thereof, it is possible to configure optimum systems for the respective area of application (for example speech or music reproduction) for the respective nature of the input signals.

The present considerations remain valid as an entity even if a different reference system than the unit circle of the imaginary plane is chosen. By way of example, instead of normalizing function values, it is also possible to normalize the axis length in order to reduce the computing time accordingly.

According to one aspect, it is recommended practice to use (inherently known) compression algorithms or data reduction methods or to analyze characteristic features such as the minima or maxima for the pseudo-stereophonic signals obtained according to EP2124486 or EP1850639, this being the case in order to speed up the evaluation thereof according to the invention.

Instead of the proposed analysis of $|\langle x(t), y(t)\rangle|$, it is also possible to use $|\langle x(t), y(t)\rangle|^2$ for optimizing the stereophonization. The computating time is significantly reduced as a result.

The invention can incidentally be applied to apparatuses or methods which generate stereophonic signals which are reproduced by more than two loudspeakers (for example surround sound systems belonging to the prior art).

According to one aspect, the invention involves the cascaded downstream connection of a plurality of means (for example logic elements), some of the parameters of which can be aligned, with an MS matrix (for example according to EP2124486 or EP1850639), wherein feedback for said apparatuses or methods involves the parameters $\phi$ or $\lambda$ or $\rho$ or f (or, respectively, n) or $\alpha$ or $\beta$ being changed in an optimized way until all constraints of the logic elements are met.

These means (logic elements) can incidentally be arranged differently, and can even—with restrictions—be omitted completely or in part.

BRIEF DESCRIPTION OF THE FIGURES

Various embodiments of the present invention and sample applications are described by way of example below, with reference being made to the following drawings:

FIG. 3 shows a first example of a circuit for selecting the definition range by using the parameter a.

FIG. 3*a* shows a second example—which is advantageous to a person skilled in the art—of a circuit for selecting a fresh definition range by using the parameter a.

DETAILED DESCRIPTION

For a stereo converter, for example in an apparatus according to EP2124486 or EP1850639—for the case of identical inversely proportional attenuations λ and ρ—optimized parameters ϕ, λ, f (or, respectively, the simplifying parameter n), α, β are to be determined in order to convert a mono signal into corresponding pseudo-stereophonic signals which have optimum decorrelation and loudness (the two criteria according to which the listener assesses the quality of a stereo signal). Such determination is intended to be achieved with as few technical means as possible.

Figure 10:
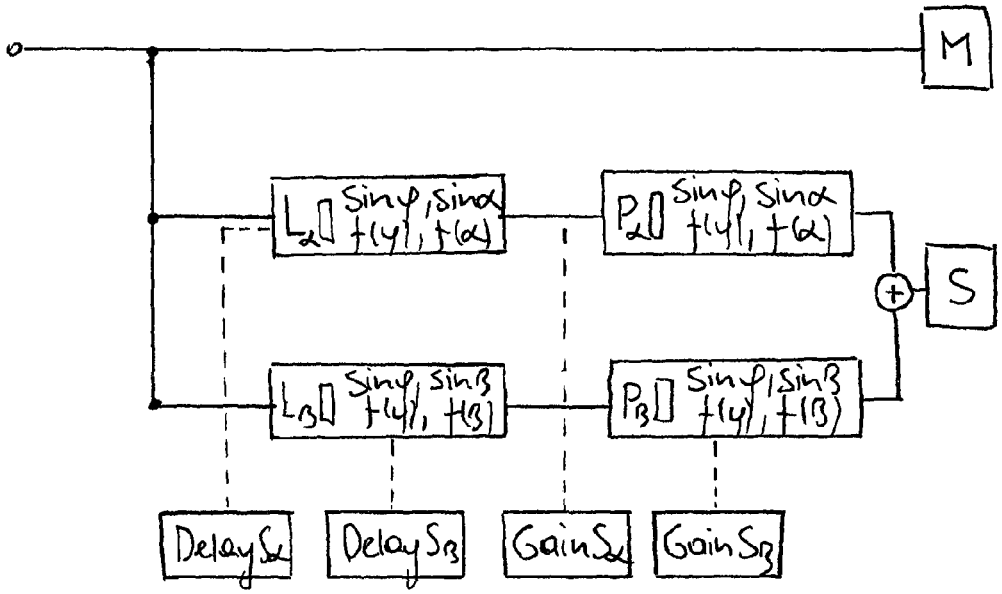
FIG. 10 shows an example of a circuit for converting a mono signal to M and S signals.
Figure 11:
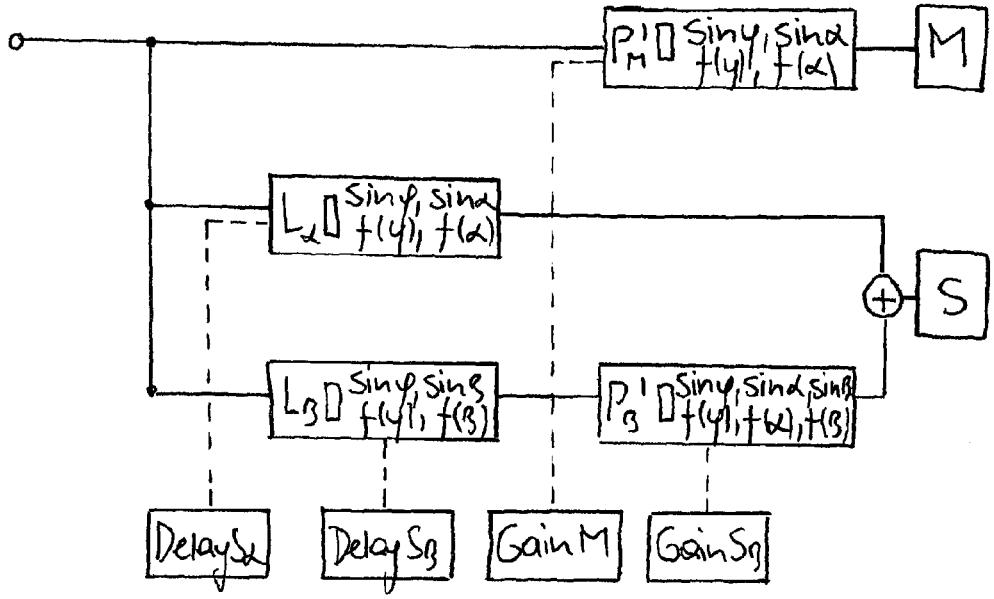
FIG. 11 shows another example of a circuit for converting a mono signal to M and S signals.

For example, as illustrated in FIGS. 10 and 11, a mono audio signal can be used to generate a main/mid (M) signal and a side (S) signal. The mono signal can be delayed and amplified to generate the M signal and two intermediate signals. The delay and amplification can be based on the parameters α, β, ϕ, and f. The two intermediate signals can be summed to generate the S signal. As described in more detail below, the M and S signals can be input to an MS matrix.

Figure 1:
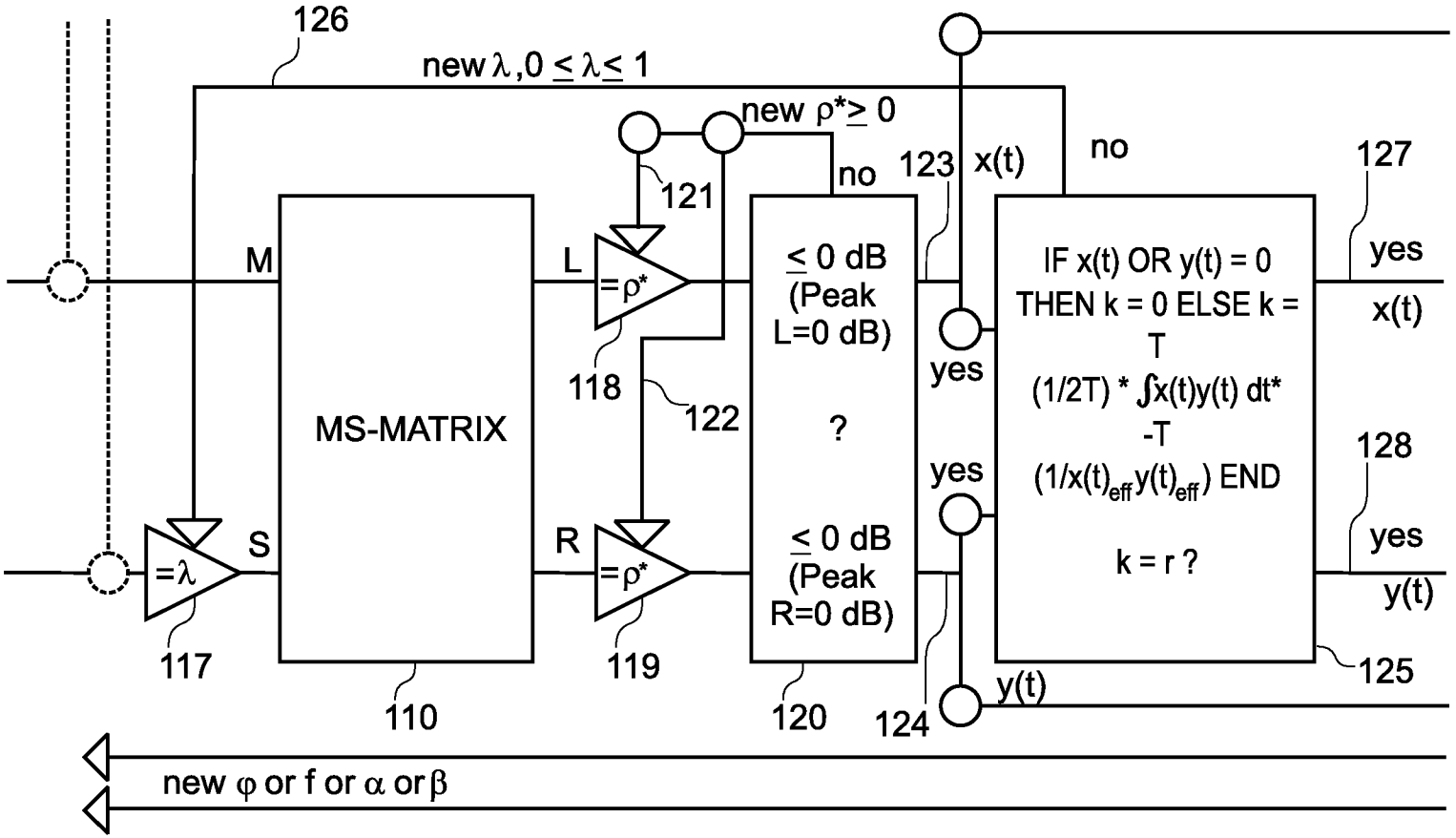
FIG. 1 shows an example of a circuit for two logic elements for normalizing the level and for normalizing the degree of correlation of the output signals from an MS matrix (for example an MS matrix according to EP2124486 or EP1850639), whereas the input signal M and S can (before passing through an amplifier upstream to the MS matrix) optionally be fed to a circuit according to FIG. 7, which is optionally also connected downstream to FIG. 6*b*.
Figure 6A:
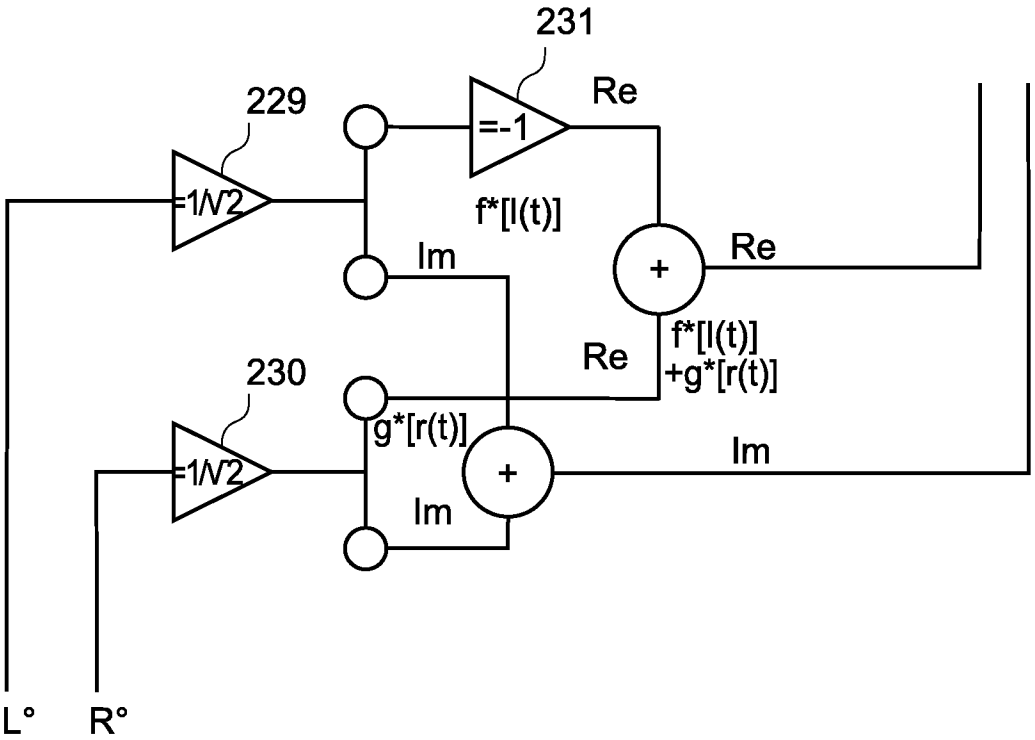
FIG. 6*a* shows an input circuit for an already existing stereo signal prior to transfer to a circuit as shown in FIG. 6*b* for determining the localization of the signal.
Figure 6B:
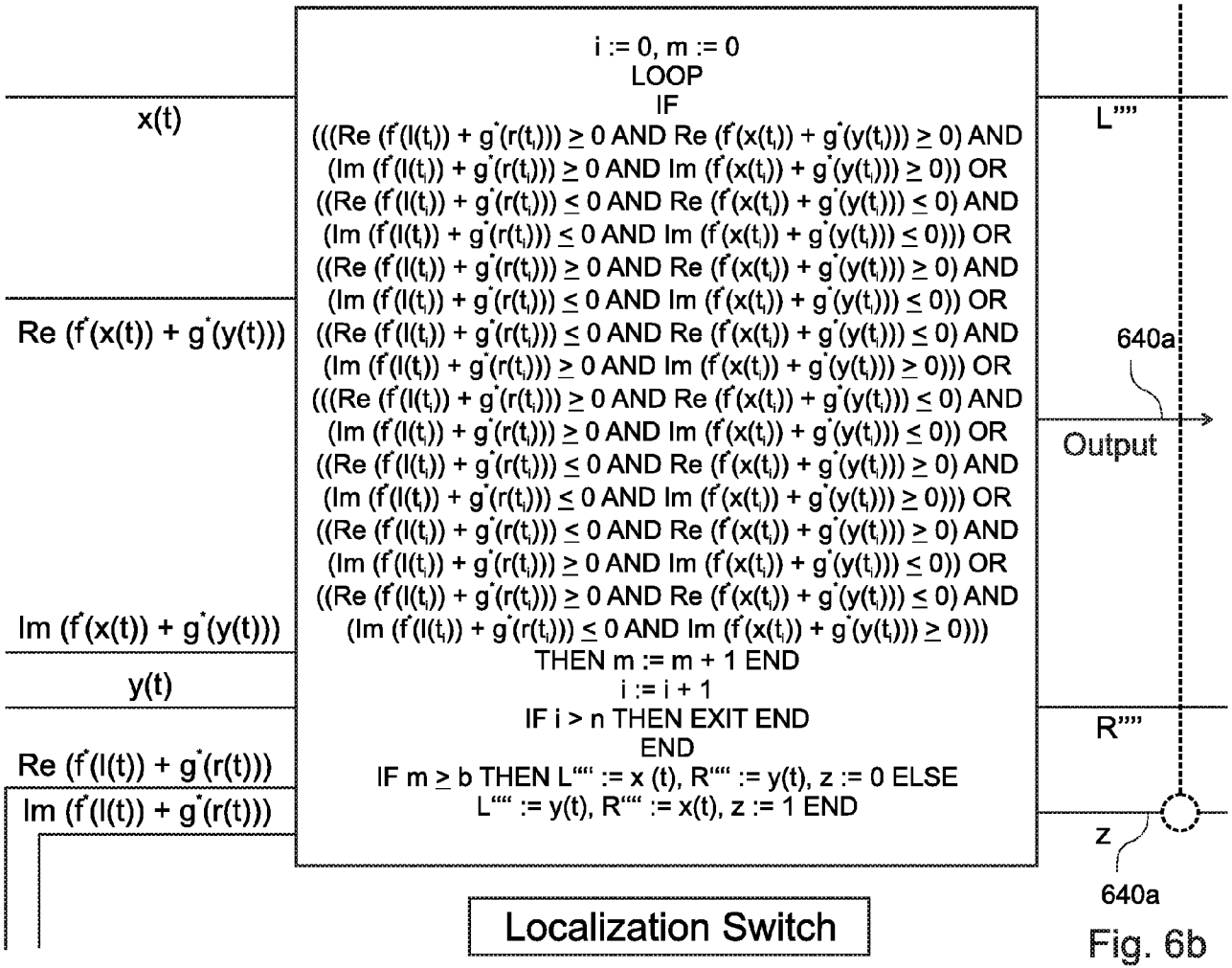
FIG. 6*b* shows a circuit for determining the localization of the signal, the inputs of which circuit are connected to the outputs in FIG. 5 or, respectively, FIG. 5*a* or, respectively, to the outputs in FIG. 6*a*.
Figure 7:
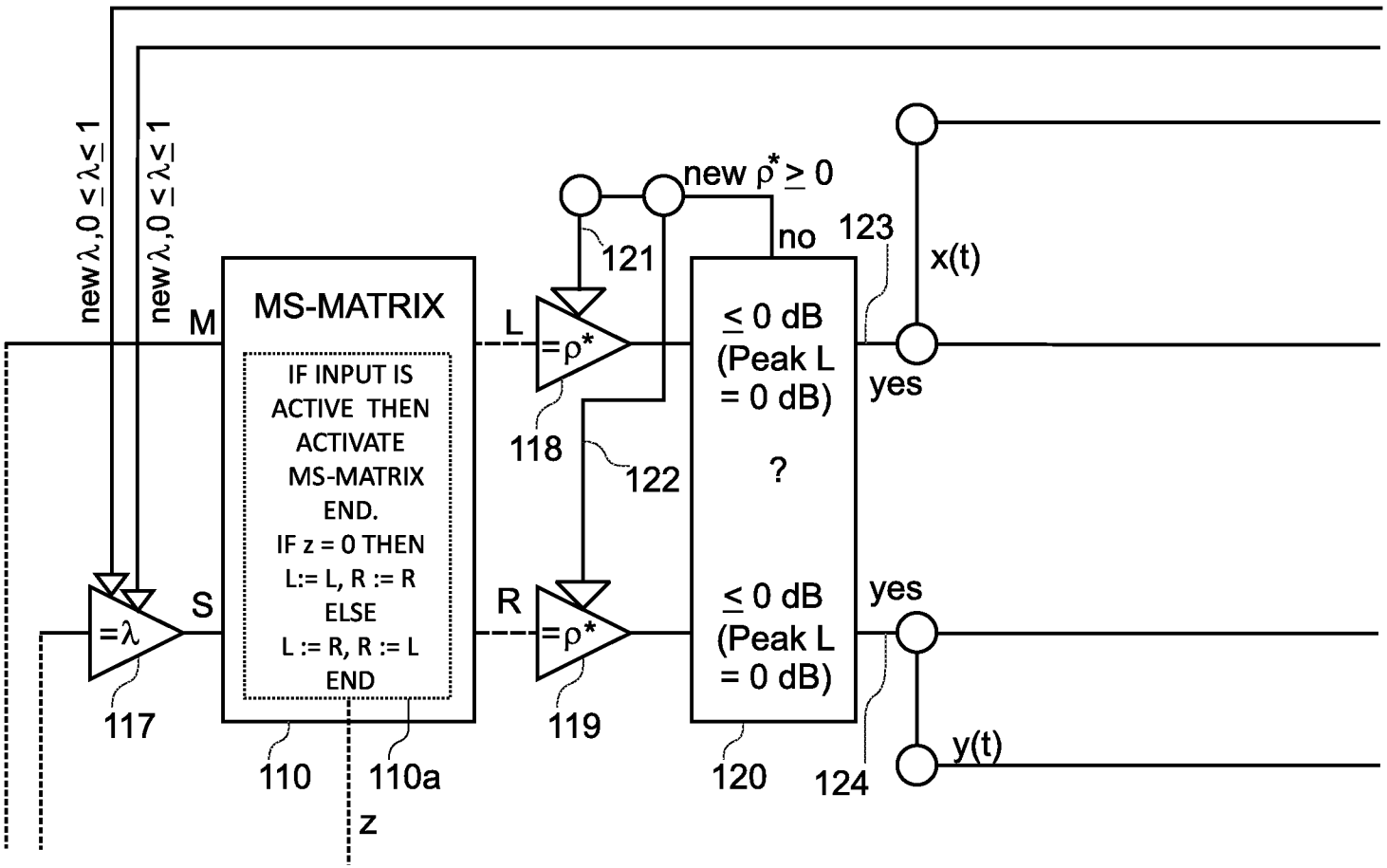
FIG. 7 shows a further example of a circuit for normalizing stereophonic or pseudo-stereophonic signals which, when connected downstream to FIG. 6*b*, is activated as soon as the parameter z is present as an input signal. In this case, the initial value of the gain factor λ corresponds to the final value of the gain factor λ in FIG. 1 when the parameter z is transferred.

FIG. 1 shows the circuit principle for the first two logic elements, as described, for normalizing the level and for normalizing the degree of correlation of the output signals from a stereo converter with an MS matrix 110 (for example a stereo converter according to EP2124486 or EP1850639), whereas the input signal M and S can (prior to passing through an amplifier connected upstream to the MS matrix) optionally be fed to a circuit as shown in FIG. 7, which is optionally and ideally connected downstream to FIG. 6*b*, and is activated as soon as the parameter z resulting from FIG. 6*b* has been determined (see below).

The first logic element 120 for normalizing the level is in this case coupled to two identical amplifiers having the gain factor ρ* and ensures a modulation, showing the maximum of 0 dB, of the left channel L and the right channel R.

The signals L and R resulting from the arrangement 110 (for example an MS matrix according to EP2124486 or EP1850639) are amplified uniformly by the factor ρ* (amplifiers 118, 119) such that the maximum of both signals has a level of exactly 0 dB (normalization on the unit circle of the complex number plane). This is achieved, by way of example, by the downstream connection of a logic element 120 which uses the feedbacks 121 and 122 and variation or correction of the gain factor ρ* of the amplifiers 118 and 119 to cause a modulation of the maximum value of L and R to reach 0 dB.

The resulting stereo signals x(t) (123) and y(t) (124), the amplitudes of which are directly proportional to L and R, are fed in a second step to a further logic element 125 which determines the degree of correlation r by using the short-time cross relation $$r = (1/2T) * \int_{-T}^{T} x(t)y(t)dt * \left(1/x(t)_{eff}\, y(t)_{eff}\right). \tag{1}$$

r can be stipulated by the user in the interval $-1 \leq r \leq 1$ and ideally ranges in the interval $0.2 \leq r \leq 0.7$.

Any deviation from r results in optimized adjustment of the gain factor λ of the amplifier 117 for the S signal via the feedback 126.

The resulting signals L and R again pass through the amplifiers 118 and 119 and also the logic element 120, which in turn causes a fresh modulation of the maximum value of L and R to reach 0 dB again via the feedbacks 121 and 122, and said signals are then fed to the logic element 125 again.

This procedure is performed in an optimized way until the degree of correlation r stipulated by the user has been attained.

The result is a stereo signal x(t), y(t) normalized in relation to the unit circle of the complex number plane.

Figure 2:
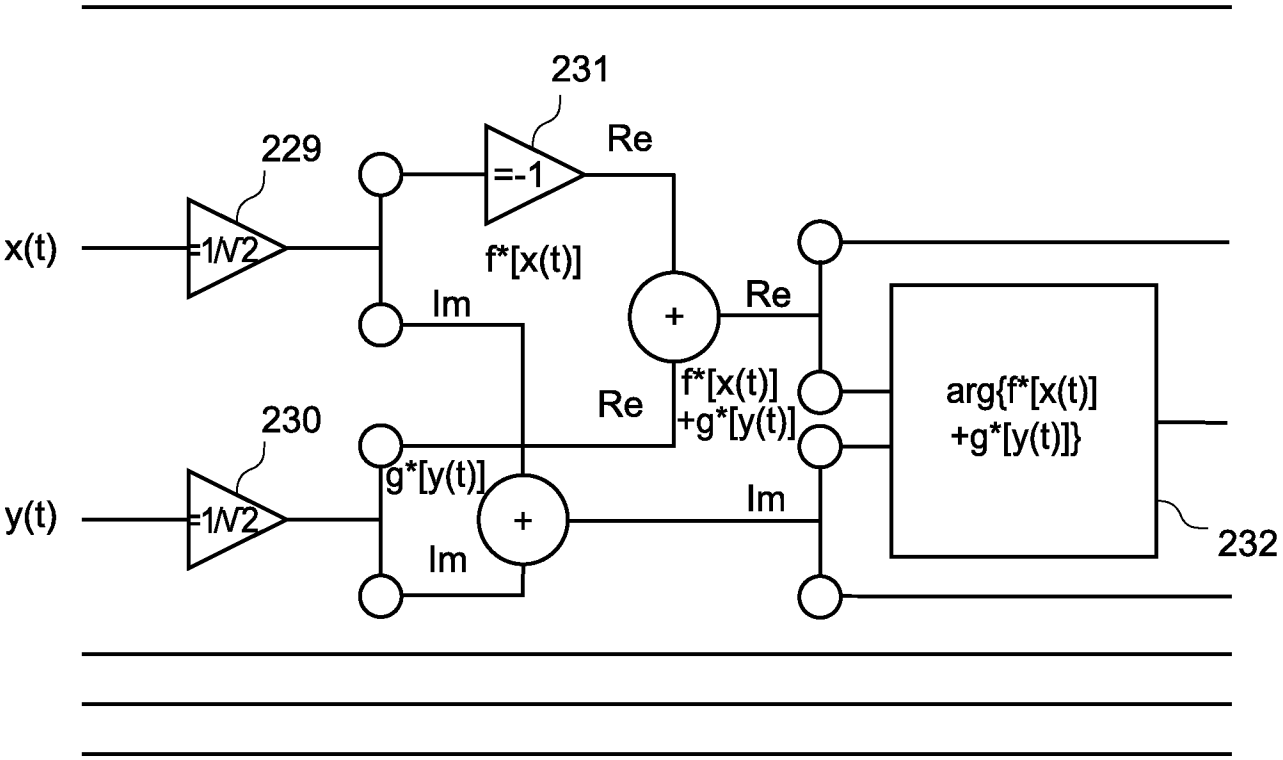
FIG. 2 shows an example of a circuit which maps given signals x(t), y(t), by using the transfer functions f*[x(t)] and g*[y(t)], on the complex number plane or ascertains the argument of the sum thereof f*[x(t)]+g*[y(t)].

FIG. 2 clarifies the circuit principle which maps the input signals x(t), y(t) on the complex number plane or determines the argument of the sum thereof f*[x(t)]+g*[y(t)]. Within this circuit the resulting signals x(t) and y(t) from the output of FIG. 1 are fed to a matrix in which, following respective amplification by the factor $1/\sqrt{2}$ (amplifiers 229, 230), said signals are broken down into respective identical real and imaginary parts, with the real part formed from the signal x(t), amplified by means of 229, additionally passing through the amplifier 231 with the gain factor −1. Therefore, the transfer functions $$f^*[x(t)]=[x(t)/\sqrt{2}]^*(-1+i) \tag{2}$$

and $$g^*[y(t)]=[y(t)/\sqrt{2}]^*(1+i) \tag{3}$$

are obtained

The respective real and imaginary parts are now summed and therefore produce the real part and the imaginary part of the sum of the transfer functions f*[x(t)]+g*[y(t)].

The element 232 determines the argument for f*[x(t)]+g*[y(t)].

Figure 3:
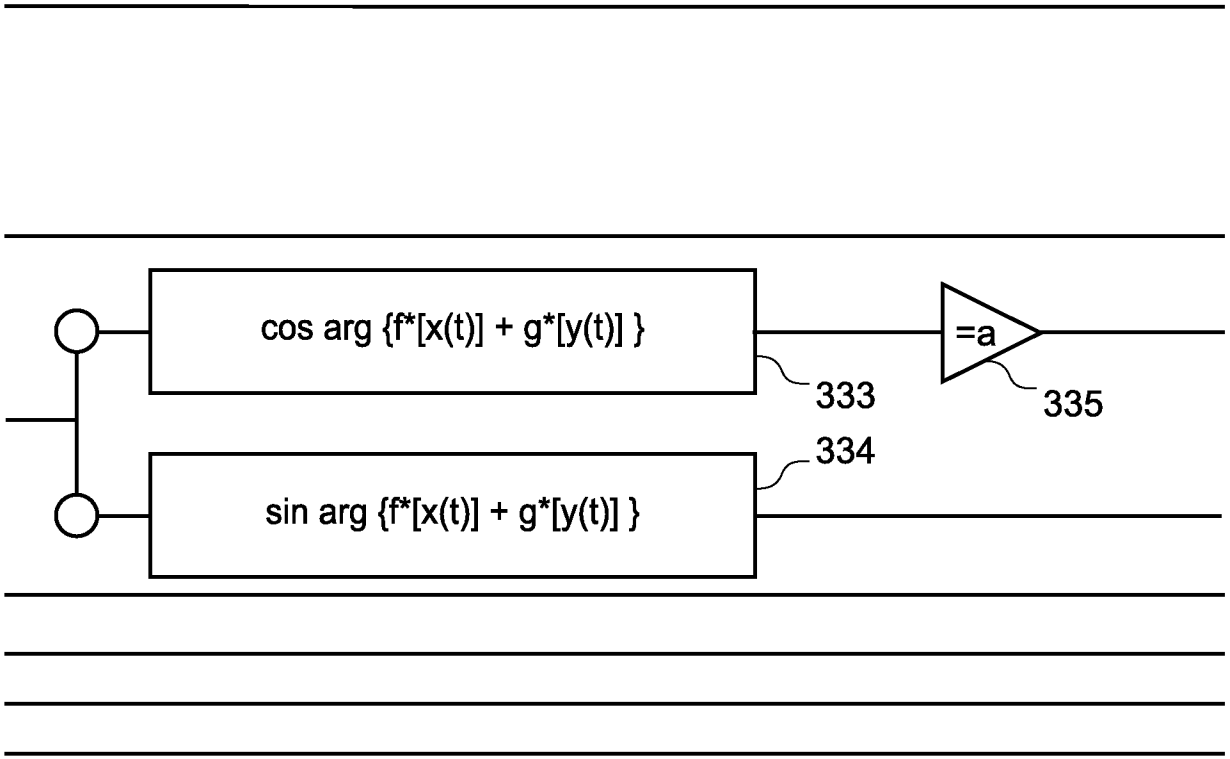

FIG. 3 clarifies the circuit principle for selecting the definition range, whereas continuous regulation is made possible by means of the parameter 0≤a≤1, on the basis of the unit circle of the complex number plane or of the imaginary axis. The user can therefore determine the definition range a on the complex number plane. For this, the cosine (333) and sine (334) of the argument which has just been determined for f*[x(t)]+g*[y(t)] are calculated. The signal resulting from 333 is then fed to an amplifier 335 and is amplified by the gain factor 0≤a≤1, such gain factor being freely selectable by the user.

Figure 4:
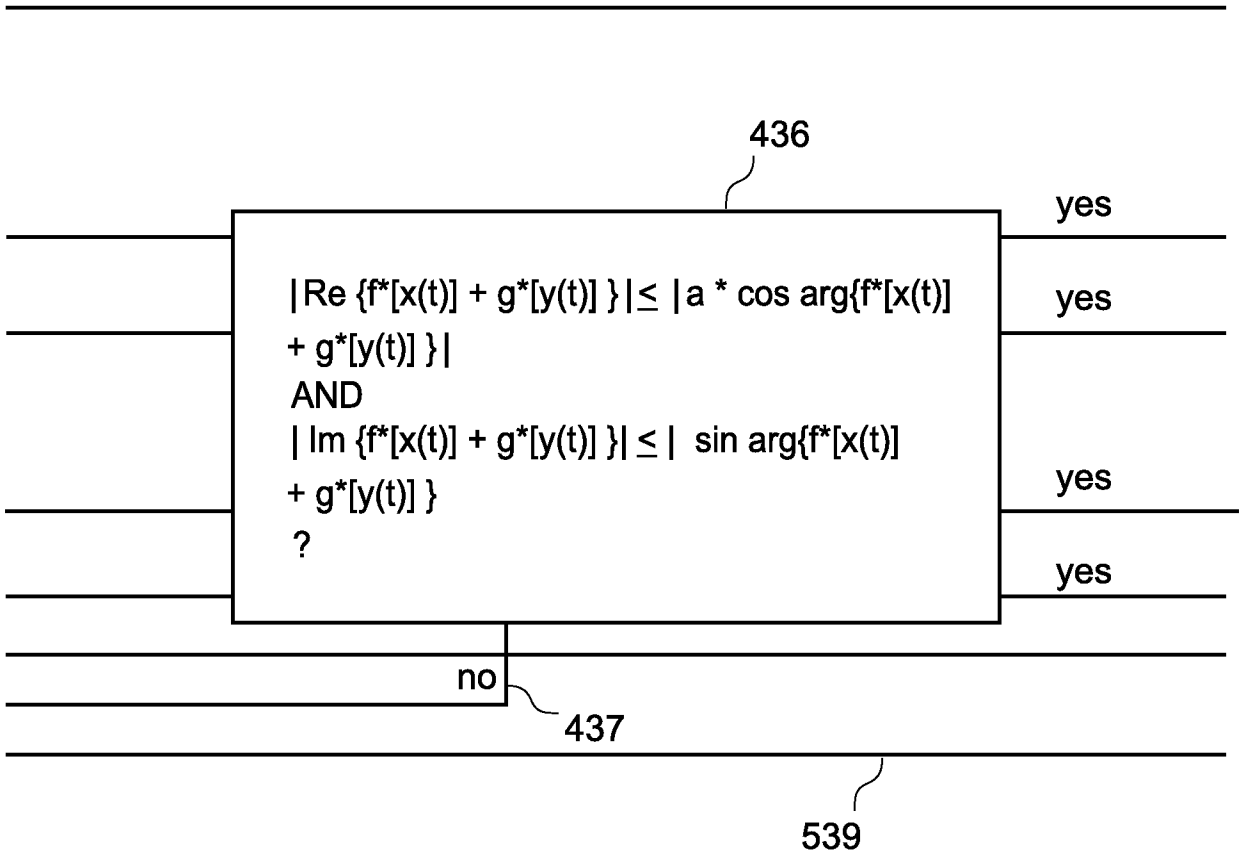
FIG. 4 shows a first example of a circuit for a third logic element which checks the signals, which are generated in FIG. 1 and which are mapped on the complex number plane as shown in FIG. 2, for the admissible definition range, defined by the parameter a, according to the constraints $|\mathrm{Re}\{f^*[x(t)]+g^*[y(t)]\}| \leq a^* \cos \arg\{f^*[x(t)]+g^*[y(t)]\}|$ and $|\mathrm{Im}\{f^*[x(t)]+g^*[y(t)]\}| \leq |\sin \arg\{f^*[x(t)]+g^*[y(t)]\}$.

FIG. 4 shows the circuit principle for the third logic element, which checks the signals, which are generated in FIG. 1 and which are mapped on the complex number plane as shown in FIG. 2, according to the constraints $$|Re\{f^*[x(t)]+g^*[y(t)]\}|\leq|a^*\cos arg\{f^*[x(t)]+g^*[y(t)]\}| \tag{4}$$

and $$|Im\{f^*[x(t)]+g^*[y(t)]\}|\leq|\sin arg\{f^*[x(t)]+g^*[y(t)]\}|. \tag{5}$$

The real part and the imaginary part of the sum of the transfer functions f*[x(t)]+g*[y(t)] and the signals resulting from 334 and 335 are in this case fed to a further logic element 436, which checks whether the criteria (4) and (5) are satisfied, hence whether the values of the sum of the transfer functions f[x(t)]+g*[y(t)] are within the range of values defined by the user by means of a.

Figure 5:
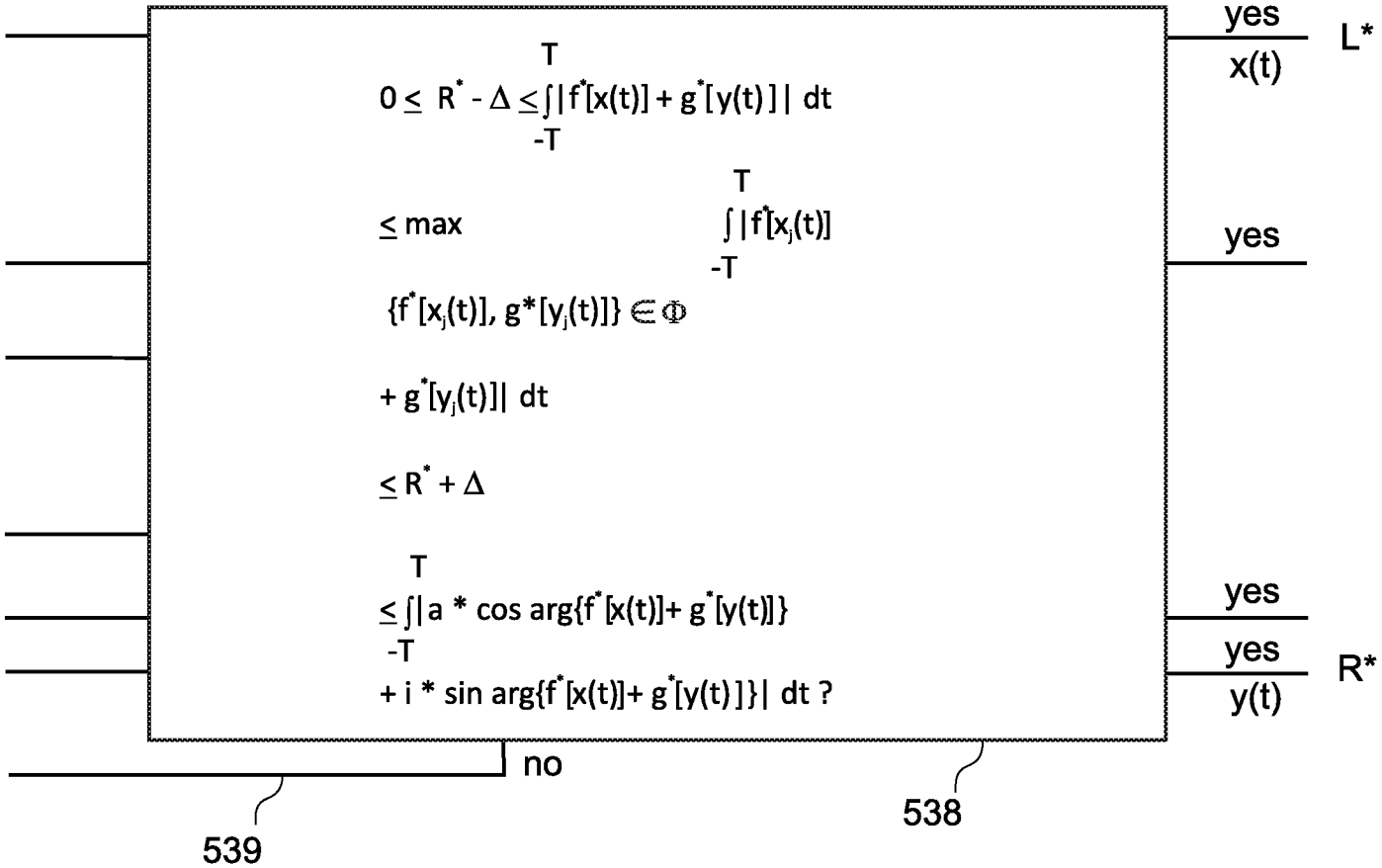
FIG. 5 shows an example of a circuit for a fourth logic element which finally analyzes the relief of the function f*[x(t)]+g*[y(t)] for the purpose of maximizing the function values thereof, whereas the user has a free choice of limit value R* defined by the inequality (8) (or of deviation Δ, likewise defined by the inequality (8)) for this maximization.

If this is not the case, a feedback 437 is used to determine new optimized values ϕ or f (or, respectively, n) or α or β, and the entire system described hitherto is passed through again until the values of the sum of the transfer functions f*[x(t)]+g*[y(t)] are within the range of values defined by the user by means of a. The output signals for the logic element 436 are now transferred to the last logic element 538 (FIG. 5).

The latter finally analyzes the relief of the function f*[x(t)]+g*[y(t)] for the purpose of maximizing the function values, whereas the user has a free choice of limit value R* determined by the inequality (8) (and of deviation Δ, likewise determined by the inequality (8)) for this maximization.

Overall, the constraint $$0 \leq R^* - \Delta \leq \int_{-T}^{T}|f^*[x(t)]+g^*[y(t)]|dt \leq \max\{f^*[x_j(t)],\ g^*[y_j(t)]\} \in \Phi\int_{-T}^{T}|f^*[x_j(t)]+g^*[y_j(t)]|dt \leq R^* + \Delta \leq \int_{-T}^{T}|a*\cos\arg\{f^*[x(t)]+g^*[y(t)]\}+i*\sin\arg\{f^*[x(t)]+g^*[y(t)]\}|dt \tag{8}$$

must be met. If this is not the case, a feedback 539 is used to iteratively determine new optimized values ϕ or f (or, respectively, n) or α or β, and the entire system described hitherto is passed through again until the relief of the function f*[x(t)]+g*[y(t)] satisfies the desired maximization of the function values taking account of the limit value R* or the deviation Δ, both defined by the user.

Figure 3A:
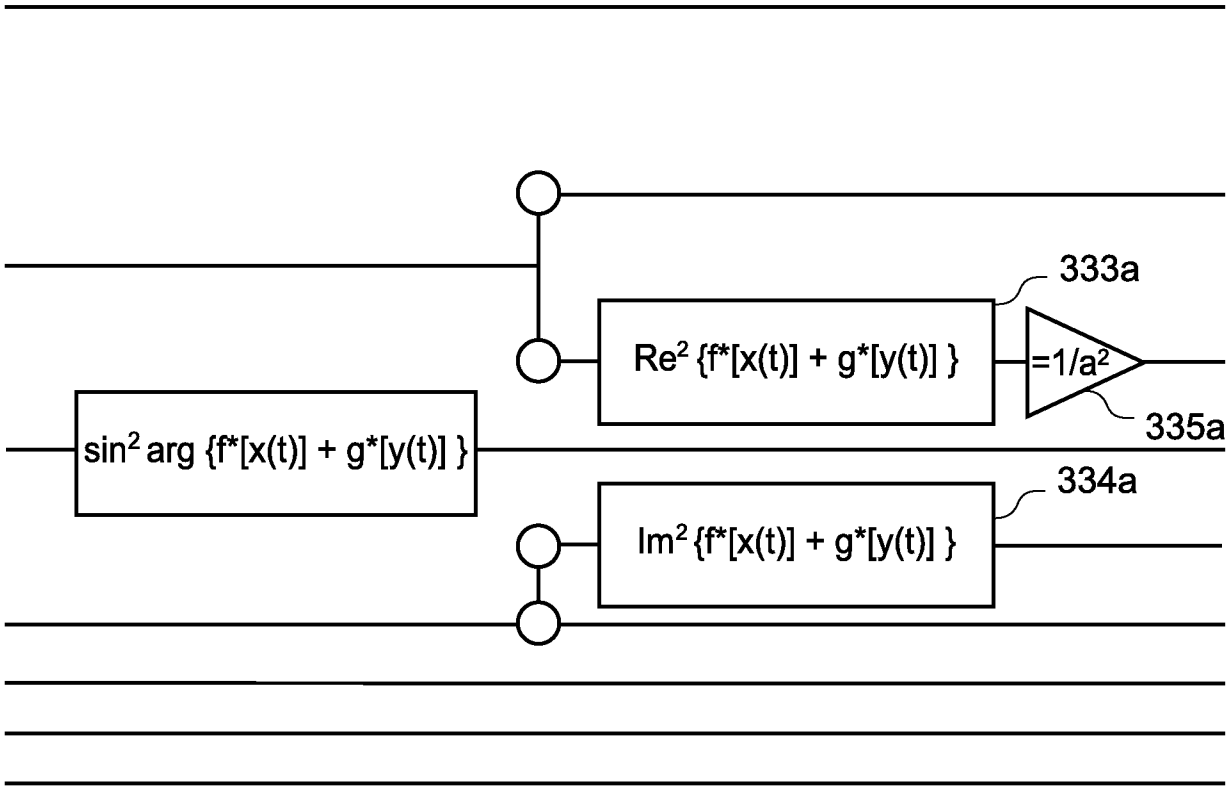
Figure 4A:
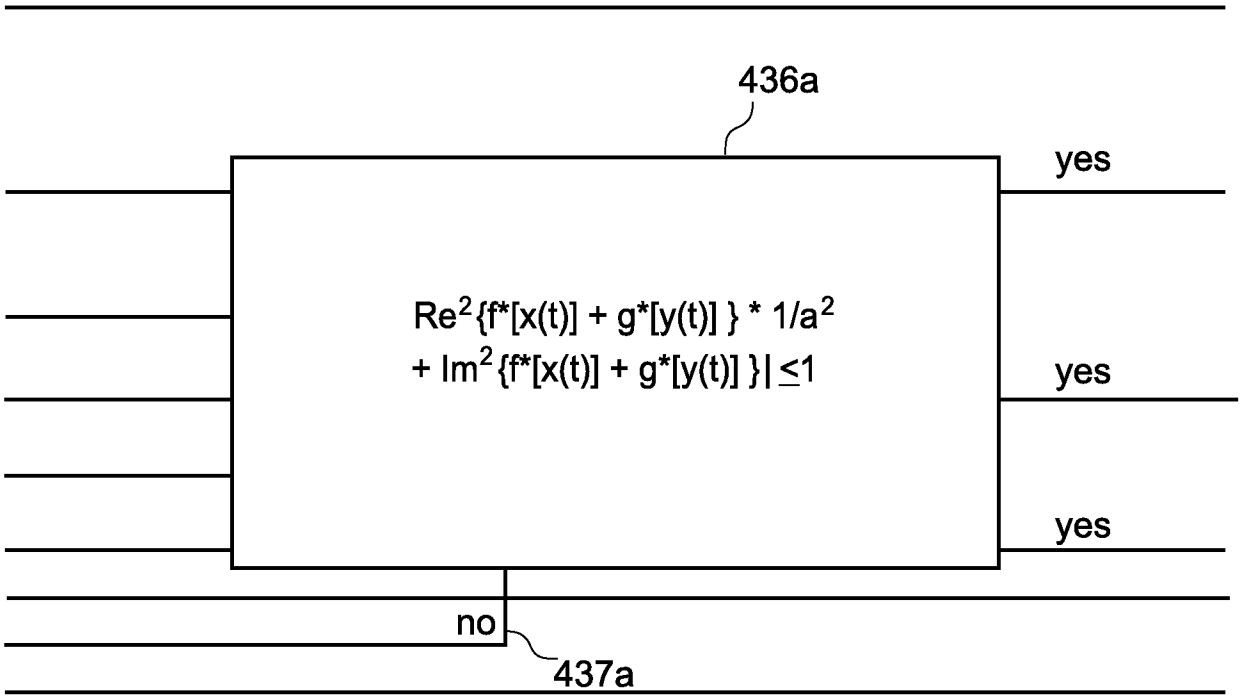
FIG. 4*a* shows a second example—which is advantageous to a person skilled in the art—of a circuit for a third logic element which checks the signals, which are generated in FIG. 1 and which are mapped on the complex number plane as shown in FIG. 2, for the admissible definition range, freshly defined by the parameter a as shown in FIG. 3*a*, according to the constraint $\mathrm{Re}^2\{f^*[x(t)]+g^*[y(t)]\}*1/a^2+\mathrm{Im}^2\{f^*[x(t)]+g^*[y(t)]\} \leq 1$.
Figure 5A:
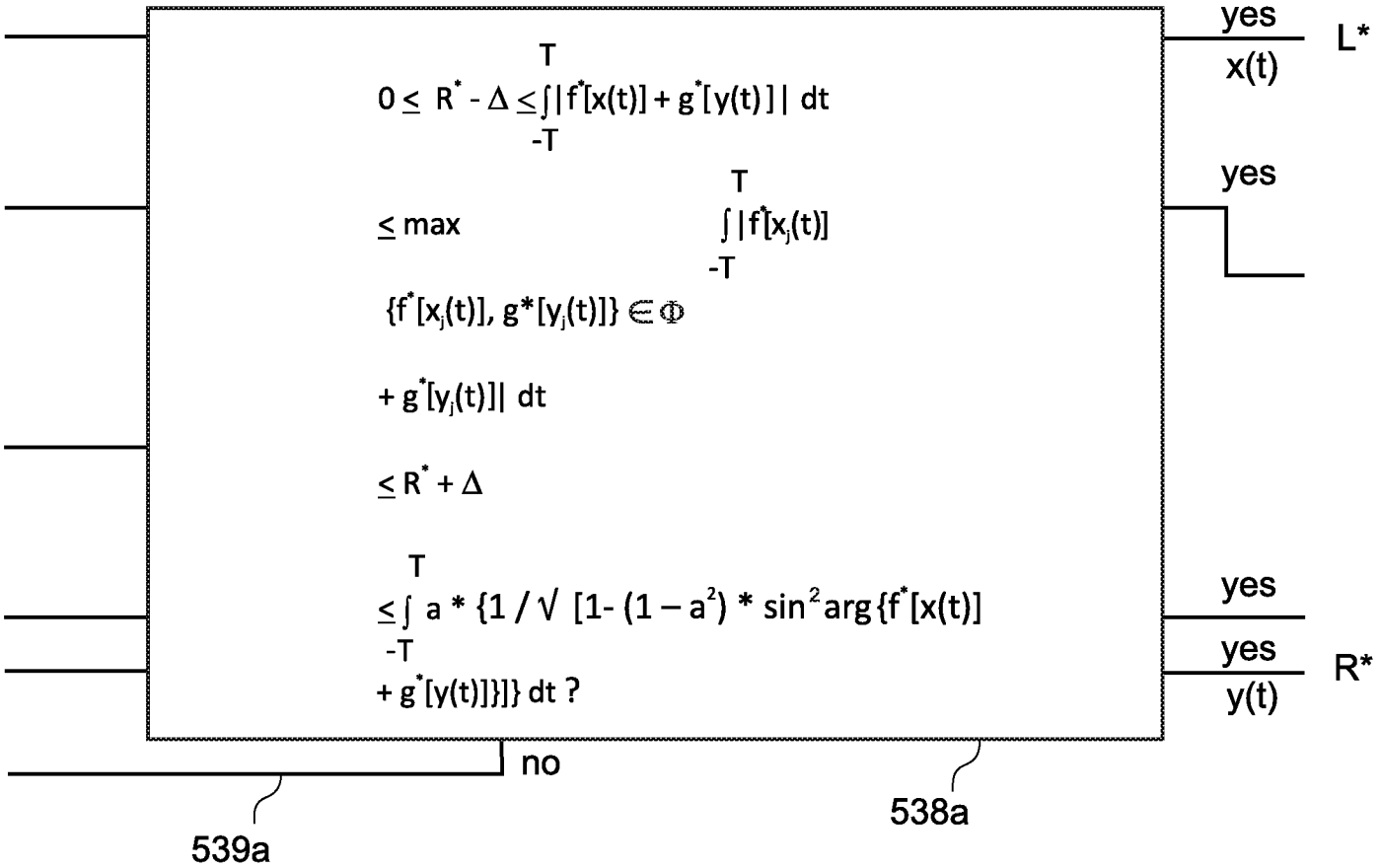
FIG. 5*a* shows a second example—which is advantageous for a person skilled in the art—of a circuit for a fourth logic element which finally analyzes the relief of the function f*[x(t)]+g*[y(t)] for the purpose of maximizing the function values thereof, whereas the user has a free choice of limit value R* defined by the inequality (8a) (or of deviation Δ, likewise defined by the inequality (8a)) for this maximization.

An alternative circuit principle which is advantageous to a person skilled in the art is clarified by FIGS. 3*a*, 4*a* and 5*a*, which replace the corresponding FIGS. 3, 4 and 5 in a preferred variant:

FIG. 3*a* in turn allows the selection of a new definition range by means of the parameter a, 0≤a≤1, wherein a is used to allow continuous regulation, on the basis of the unit circle of the complex number plane or of the imaginary axis. The user can therefore freely stipulate the definition range determined by a on the complex number plane within the unit circle. For this, the squared real part (333*a*) and the squared imaginary part (334*a*) of f*[x(t)]+g*[y(t)] are calculated. The signal resulting from 333*a* is then fed to an amplifier 335*a* and is amplified by the gain factor $1/a^2$, which is freely selectable by the user. In addition, the squared sine of the argument of the sum of the transfer functions f*[x(t)]+g*[y(t)] is calculated.

FIG. 4*a*, which is intended to be connected downstream to the output of FIG. 3*a*, shows a circuit principle—which is advantageous to a person skilled in the art—for a new third logic element, which checks the signals, which are generated in FIG. 1 and which are mapped on the complex number plane as shown in FIG. 2, according to the simplified constraint $$Re^2\{f^*[x(t)]+g^*[y(t)]\}^*1/a^2+Im^2\{f^*[x(t)]+g^*[y(t)]\}\leq 1. \tag{4a}$$

The squared real part and the squared imaginary part of the sum of the transfer functions f*[x(t)]+g*[y(t)] and the signals resulting from 334*a* and 335*a* are in this case fed to a further logic element 436*a*, which checks whether the above criterion is satisfied, hence whether the values of the sum of the transfer functions f*[x(t)]+g*[y(t)] are within the new range of values defined by the user by means of a.

If this is not the case, a feedback 437*a* is used to determine new optimized values ϕ or f (or, respectively, n) or α or β, and the entire system described hitherto is passed through again until the values of the sum of the transfer functions f*[x(t)]+g*[y(t)] are within the new range of values defined by the user by means of a. The output signals for the logic element 436*a* are now transferred to the last logic element 538*a* (FIG. 5*a*).

The latter finally analyzes the relief of the function f*[x(t))]+g*[y(t)] for the purpose of maximizing the function values, whereas the user has a free choice of limit value R* determined by the inequality (8a) (and also of deviation Δ, likewise determined by the inequality (8a)) for this maximization. Overall, the constraint $$0 \le R^* - \Delta \le \int_{-T}^{T} |f^*[x(t)] + g^*[y(t)]| dt \le \max\{f^*[x_j(t)], g^*[y_j(t)]\} \in \Phi \int_{-T}^{T} |f^*[x_j(t)] + g^*[y_j(t)]| dt \le R^* + \Delta \le \int_{-T}^{T} a * \{1 / \sqrt{[1 - (1 - a^2) * \sin^2 \arg\{f^*[x(t)] + g^*[y(t)]\}]}\} dt \quad (8a)$$

must freshly be met. If this is not the case, a feedback 539*a* is used to iteratively determine new optimized values $\phi$ or f (or, respectively, n) or $\alpha$ or $\beta$, and the entire new system described hitherto is passed through again until the relief of the function f*[x(t)]+g*[y(t)] satisfies the desired maximization of the function values taking account of the limit value R* or the deviation $\Delta$, both (re)defined by the user.

Hence, the original pseudo-stereo converter, for example according to one of the embodiments in EP2124486 or EP1850639 (in this case assuming the instance of identical inversely proportional attenuations $\lambda$ and $\rho$), is used to iteratively determine new parameters $\phi$ or f (or, respectively, n) or $\alpha$ or $\beta$ until x(t) and y(t) meet the aforementioned constraints (4), (5) and (8) or (4a) and (8a).

In terms of compatibility (determined by the selectable degree of correlation r), definition range (determined by the selectable gain factor a) and loudness (determined by the selectable limit value R* or the selectable deviation $\Delta$), the signals x(t) (123) and y(t) (124) therefore correspond to the selections by the user and are the output signals L* and R* from the arrangement described.

Stipulation of the Mapping Direction

Occasionally, it is also important to mirror the stereophonic mapping obtained about the main axis of the directional pattern on which the stereophonic processing is based, since, for instance, mirror-inverted mapping in relation to the main axis occurs. This can be achieved manually by swapping the left channel and the right channel.

If an already existing stereo signal L°, R° is to be mapped by the present system, the correct mapping direction can also be ascertained automatically on behalf of the phantom sources generated by means of the illustrated pseudo-stereophonic methodology, by way of example, as is shown in FIG. 6*b* (which is directly connected downstream to FIG. 5 or FIG. 5*a*, whereas FIG. 6*a* may likewise be added to FIG. 6*b* for determining the sum of the complex transfer functions $f^*(l(t_i))+g^*(r(t_i))$ for the already existing stereo signal L°, R°). In this case, at suitably chosen times $t_i$ (for which not all of the subsequently cited correlating function values of the transfer functions $f(x(t_i))+g^*(y(t_i)$ or, respectively, $f^*(l(t_i))+g^*(r(t_i))$ may be equal to zero for at least one case), the already ascertained transfer function $f^*(x(t_i))+g^*y(t_I))$ as shown in FIG. 2 is compared with the transfer function $f^*(l(t_i))+g^*(r(t_i))$ of the left signal l(t) and the right signal r(t) of the original stereo signal L°, R° (which transfer function is ascertained by using the circuit shown in FIG. 6*a*, the design of which corresponds to the first part of the circuit for the input signals x(t), y(t) in FIG. 2). If these transfer functions range in the same quadrant or in the diagonally opposite quadrant of the complex number plane, the total number m of function values from the cited transfer functions which are located in the same quadrant or in the diagonally opposite quadrant of the complex number plane is increased by 1 in each case.

An empirically (or statistically ascertained) stipulatable number b, which should be less than or equal to the number of correlating function values of the transfer functions $f^*(x(t_i))+g^*(y(t_I)$ and $f^*(l(t_i))+g^*(r(t_i))$ unequal to zero, now stipulates the number of necessary matches. Below this number, the left channel x(t) and the right channel y(t) of the stereo signal resulting, for example, from an arrangement as shown in FIGS. 1-5 or FIGS. 1, 2, 3*a* to 5*a* are swapped.

If an originally stereophonic signal is to be encoded into a mono signal plus the function f describing the directional pattern (or, respectively, the simplifying parameter n of said function) and likewise the parameters $\phi$, $\alpha$, $\beta$, $\lambda$ or $\rho$ (for example for the purpose of data compression) (for an exemplary output 640*a* which may be enhanced by the parameter z, see below), it makes sense to jointly encode the information regarding whether the resulting left channel and the resulting right channel need to be swapped (for example expressed by the parameter z, which takes the value 0 or 1, and, if desired, can simultaneously activate a circuit as shown in FIG. 7).

With slight modifications, similar circuits to the circuits shown in FIGS. 6*a* and 6*b* can be constructed which can also be used at another location within the electrical circuit or algorithm.

Narrowing or Expanding of the Mapping Width

For this application too, the additional use of compression algorithms or data reduction methods which are part of the prior art or the consideration of characteristic features, such as the minima or maxima for the pseudo-stereophonic signals obtained, is recommended in order to speed up evaluation thereof in accordance with the invention.

Of particular interest (for example for reproducing stereophonic signals in automobiles) is the subsequent narrowing or expanding of the mapping width of the stereo signal obtained by using the specific variation of the degree of correlation r of the resulting stereo signal or, respectively, the attenuations $\lambda$ or else $\rho$ (for forming the resulting stereo signal). The previously determined parameters f (or, respectively, n) which describe the directional pattern of the signal that is to be stereophonized, the angle $\alpha$—to be ascertained manually or by metrology—enclosed by the main axis and the sound source, the fictitious left opening angle $\alpha$ and the fictitious right opening angle $\beta$ can be retained in this case, and it makes sense that now only final amplitude correction is necessary, for example as per the logic element 120 in FIG. 1, provided that this narrowing or expanding of the mapping width is performed manually.

If this is intended to be automated, series of psychoacoustic experiments show that a constant mapping width is essentially dependent on the criterion $$0 \le S^* - \epsilon \le \max|Re\{f^*[x(t)] + g^*[y(t)]\}| \le S^* + \epsilon \le 1 \quad (9)$$

and also on the criterion $$0 \le U^* - \kappa \le \int_{-T}^{T} |\{f^*[x(t)] + g^*[y(t)]\}| dt \le U^* + \kappa \quad (10)$$

(where S* and $\epsilon$ or, respectively, U* and $\kappa$ need to be stipulated differently for telephone signals, for example, than for music recordings). Accordingly, it is now necessary to determine only suitable function values x(t), y(t) which are dependent on the degree of correlation r of the resulting stereo signal or, respectively, on the attenuations $\lambda$ or else $\rho$ (for the formation of the resulting stereo signal) or, where required, on a logic element which is identical to the logic element 120 in FIG. 1, in accordance with an iterative operating principle which is based on feedback.

Figure 8:
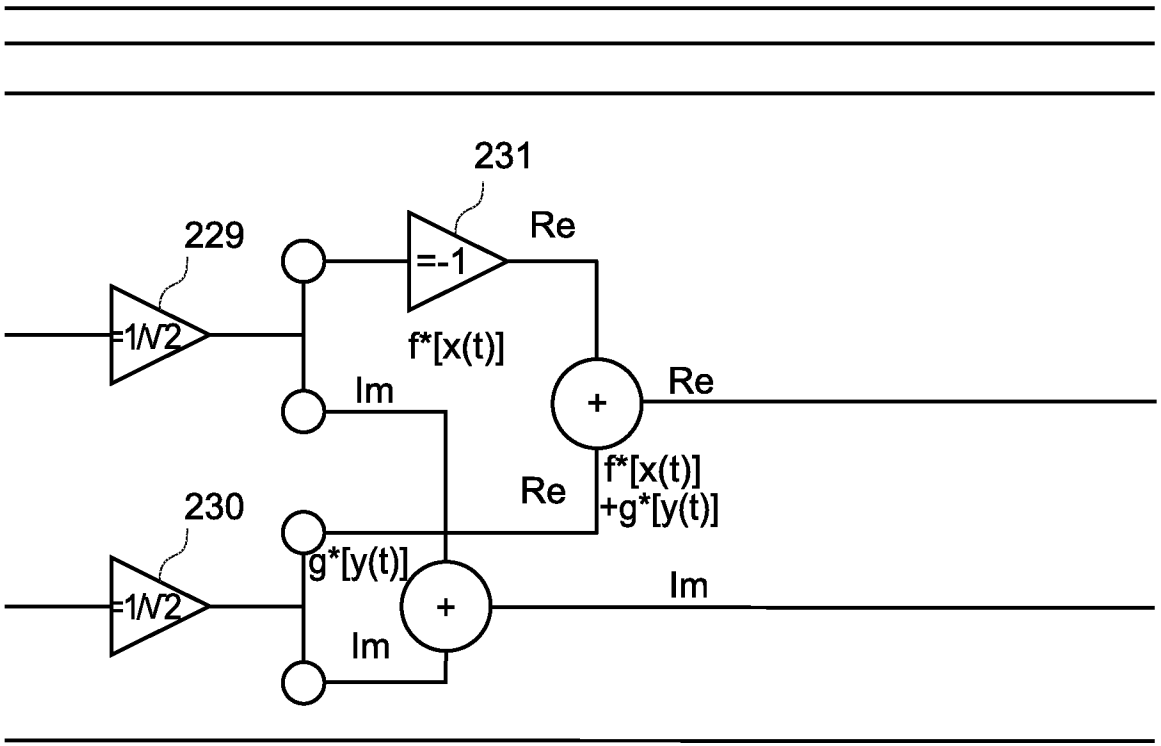
FIG. 8 shows an example of a circuit which maps given signals x(t), y(t) on the complex number plane by using the transfer functions f*[x(t)] and g*[y(t)].

The arrangement according to the invention in FIGS. 1 to 5, 6*a* and 6*b* or FIGS. 1, 2, 3*a* to 5*a*, 6*a*, 6*b* can accordingly be enhanced within the context of an arrangement, for instance, of the form shown in FIGS. 7, 8 and/or 9. FIG. 7 thereby shows a further example of a circuit for normalizing stereophonic or pseudo-stereophonic signals which, when connected downstream to FIG. 6*b*, is activated as soon as the parameter z is present as an input signal. In this case, the initial value of the gain factor λ corresponds to the final value of the gain factor λ in FIG. 1 when the parameter z is transferred, and the input signals in FIG. 1 are transferred directly as input signals to FIG. 7 at the time of this transfer.

Figure 9:
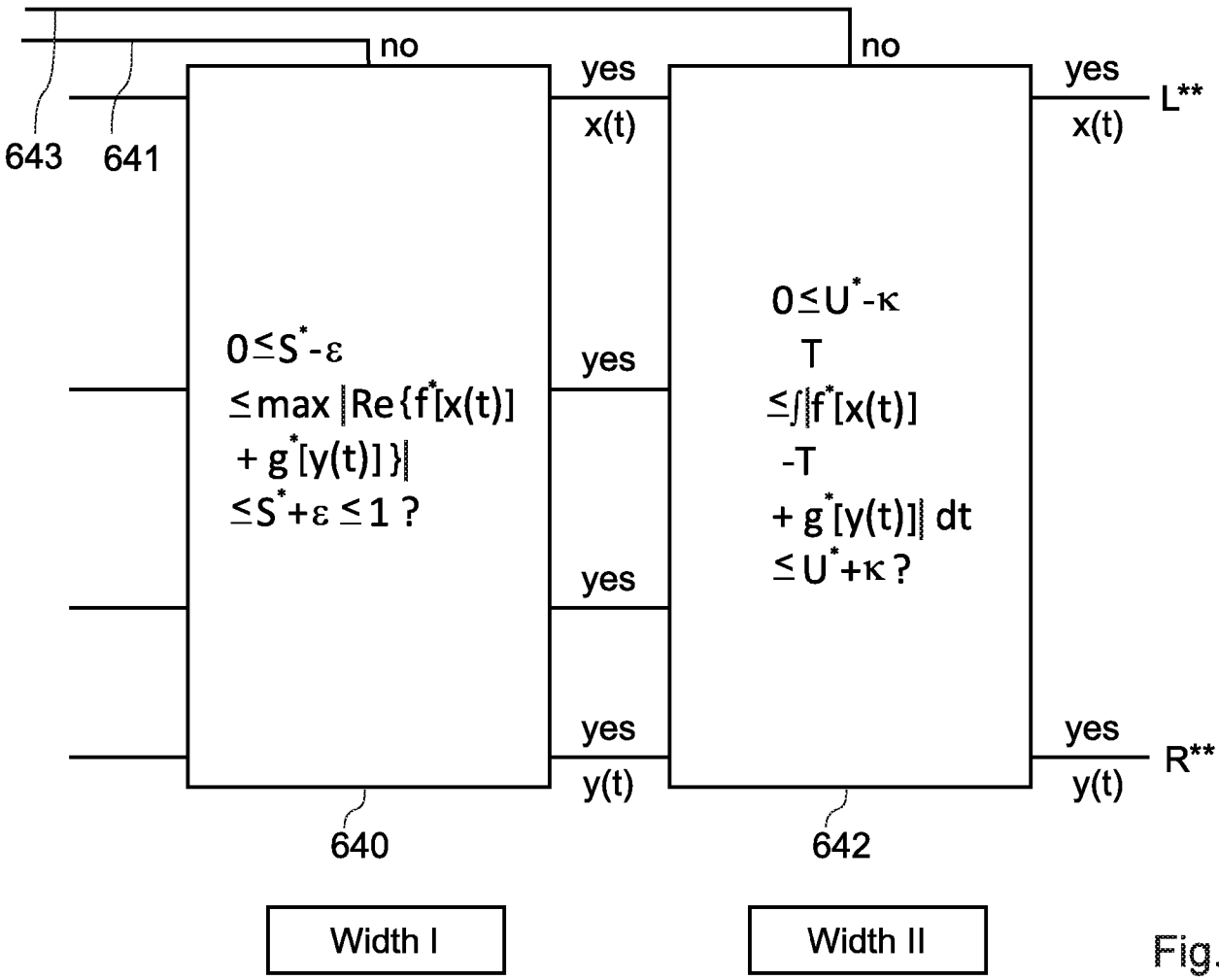
FIG. 9 shows an example of a circuit for adjusting the mapping width of an audio signal.

The circuits shown in FIGS. 7 to 9 can incidentally also be used autonomously in other circuits or algorithms.

In the present arrangement, the left channel and the right channel are swapped in the MS matrix 110 by using a logic element 110*a* (which also activates this MS matrix as soon as the parameter z is present as an input signal), provided that the parameter z is equal to 1, otherwise such a swap does not take place.

The resulting output signals L and R from the MS matrix 110 are now amplified (amplifiers 118, 119) uniformly by the factor ρ* such that the maximum of both signals has a level of exactly 0 dB (normalization on the unit circle of the complex number plane). By way of example, this is achieved by the downstream connection of a logic element 120 which uses the feedbacks 121 and 122 and variation or correction of the gain factor ρ* of the amplifiers 118 and 119 to cause a modulation of the maximum value of L and R to reach 0 dB.

In a further step, the resulting signals x(t) (123) and y(t) (124) are now fed to a matrix as shown in FIG. 8 in which, following respective amplification by the factor $1/\sqrt{2}$ (amplifiers 229, 230), they are split into respective identical real and imaginary parts, with the real part formed from the signal x(t), amplified by means of 229, additionally passing through the amplifier 231 with the gain factor −1. The complex transfer functions f*[x(t)] and g*[y(t)] already mentioned in connection with FIG. 2 are therefore obtained. The respective real and imaginary parts are now summed and thus result in the real part and the imaginary part of the sum of the transfer functions f*[x(t)]+g*[y(t)].

An arrangement, for example based on the logic element 640 in FIG. 9, now needs to be connected downstream, which arrangement checks, for a limit value S*—suitably chosen by the user with respect to the mapping width of the stereo signal that is to be achieved—or a suitably chosen deviation ϵ—both defined by the inequality (9)—whether the constraint $$0 \le S^* - \epsilon \le \max|Re\{f^*[x(t)]+g^*[y(t)]\}| \le S^* + \epsilon \le 1 \quad (9)$$

is met. If this is not the case, a feedback 641 is used to determine a new optimized value for the degree of correlation r or, respectively, for the attenuations λ or else ρ (for the formation of the resulting stereo signal), and the previous steps just described, as illustrated in FIGS. 7 to 9, are performed until the above constraint (9) is met.

The output signals for the logic element 640 are now transferred to an arrangement, for example based on the logic element 642 in FIG. 9. Such arrangement finally analyzes the relief of the function f*[x(t)]+g*[y(t)] for the purpose of optimizing the function values in terms of the mapping width of the stereo signal that is to be achieved, the user being able to suitably select the limit value U* and the deviation κ, both defined by the inequality (10), with respect to the mapping width of the stereo signal that is to be achieved. Overall, the constraint $$0 \le U^* - \kappa \le \int |f^*[x(t)]+g^*[y(t)]|\,dt \le U^* + \kappa \quad (10)$$

must be met. If this is not the case, a feedback 643 is used to determine a new optimized value for the degree of correlation r or, respectively, for the attenuations λ or else ρ (for the formation of the resulting stereo signal), and the previous steps just described, as illustrated in FIGS. 7 to 9, are performed until the relief of the function f*[x(t)]+g*[y(t)] satisfies the desired optimization of the function values with respect to the mapping width taking account of the limit value U* and the deviation κ, both suitably chosen by the user.

In terms of the mapping width—determined by the degree of correlation r or, respectively, the attenuations λ or else ρ (for the formation of the resulting stereo signal)—the signals x(t) (123) and y(t) (124) therefore correspond to the selections by the user and represent the output signals L and R from the arrangement which has just been described.

Areas of Application for the Invention

The arrangement just described, or portions of this arrangement, can be used as an encoder for a full-fledged stereo signal that is limited to a mono signal plus the parameters ϕ, f (or, respectively, the simplifying parameter n), α, β, λ or ρ.

An already existing stereo signal can be evaluated in respect of r or a or R* or Δ or the mapping direction (or parameters S* or ϵ or U* or κ described below) and can then likewise be anew encoded as a mono signal by using the parameters ϕ, f (or, respectively, n), α, β, λ or ρ in view of an apparatus or a method according to EP2124486 or EP1850639.

Similarly, the arrangement just described, to which the elements below may possibly be added, can be used as a decoder for mono signals. If ϕ, f (or, respectively, n), α, β, λ or ρ or the mapping direction (for example expressed by the parameter z, which can assume the value 0 or 1) are known, such a decoder is reduced to an arrangement according to EP2124486 or EP1850639.

Overall, such encoders or decoders can be used wherever audio signals are recorded, transduced/converted, transmitted or reproduced. They are an excellent alternative to multichannel stereophonic techniques.

Specific areas of application are telecommunications (hands-free devices), global networks, computer systems, broadcasting and transmission devices, particularly satellite transmission devices, professional audio technology, television, film and broadcasting and also electronic consumer goods.

The invention is also of particular importance in connection with the obtaining of stable FM stereo signals under bad reception conditions (for example in automobiles). In this case, it is possible to achieve stable stereophony by simply using the main channel signal (L+R) as an input signal, which is the sum of the left channel and the right channel of the original stereo signal. The complete or incomplete subchannel signal (L−R), which is the result of subtracting the right channel from the left channel of the original stereo signal, can also be used in this case in order to form a useable S signal or in order to determine or optimize the parameters f (or, respectively, n), which describe the directional pattern of the signal that is to be stereophonized, the angle ϕ—to be ascertained manually or by metrology—enclosed by the main axis and the sound source, the fictitious left opening angle α, the fictitious right opening angle β, the attenuations λ or else ρ for the formation of the resulting stereo signal or, resulting therefrom, the gain factor ρ* in FIG. 1 for normalizing the left channel and the right channel, resulting from the MS matrixing or from another arrangement according to the invention, on the unit circle (in this case 1, for example, corresponds to the maximum level of 0 dB which has been normalized by using ρ*, where x(t) is the left output signal resulting from this normalization and y(t) is the right output signal resulting from this normalization) or the degree of correlation r of the resulting stereo signal or the gain factor a for defining the admissible range of values for the sum of the transfer functions of the resulting output signals (for example the complex transfer functions $$f^*[x(t)]=[x(t)/\sqrt{2}]^*(-1+i) \tag{2}$$

and $$g^*[y(t)]=[y(t)/\sqrt{2}]^*(1+i) \tag{3}$$

where, for 0≤a≤1, for example, the following is true:

$$|Re\{f^*[x(t)]+g^*[y(t)]\}|\leq|a^*\cos arg\{f^*[x(t)]+g^*[y(t)]\}| \tag{4}$$

and $$|Im\{f^*[x(t)]+g^*[y(t)]\}|\leq|\sin arg\{f^*[x(t)]+g^*[y(t)]\}|). \tag{5}$$

(a person skilled in the art would advantageously replace constraints (4) and (5), given the same parameter a, 0≤a≤1, with the new constraint $$Re^2\{f^*[x(t)]+g^*[y(t)]\}^*1/a^2+Im^2\{f^*[x(t)]+g^*[y(t)]\}\leq 1) \tag{4a}$$

or the limit value R* or the deviation Δ for stipulating or maximizing the absolute value of the function values of the sum of these transfer functions (where, for this stipulation or maximization and for the time interval [−T, T] or, respectively, the total number of possible output signals $x_j(t)$, $y_j(t)$, the following is true, for example:

$$\begin{aligned} 0 \leq R^* - \Delta \leq \int_{-T}^{T} |f^*[x(t)] + g^*[y(t)]|dt \leq \max\{f^*[x_j(t)],\ g^*[y_j(t)]\} \in \\ \Phi \int_{-T}^{T} |f^*[x_j(t)] + g^*[y_j(t)]|dt \leq R^* + \Delta \leq \\ \int_{-T}^{T} |a * \cos\arg\{f^*[x(t)] + g^*[y(t)]\} + \\ i * \sin\arg\{f^*[x(t)] + g^*[y(t)]\}|dt) \end{aligned} \tag{8}$$

(a person skilled in the art would advantageously replace constraint (8) with $$\begin{aligned} 0 \leq R^* - \Delta \leq \int_{-T}^{T} |f^*[x(t)] + g^*[y(t)]|dt \leq \max\{f^*[x_j(t)],\ g^*[y_j(t)]\} \in \\ \Phi \int_{-T}^{T} |f^*[x_j(t)] + g^*[y_j(t)]|dt \leq R^* + \Delta \leq \\ \int_{-T}^{T} a * \{1/\sqrt{[1-(1-a^2)*\sin^2\arg\{f^*[x(t)] + g^*[y(t)]\}]}\}dt) \end{aligned} \tag{8a}$$

or the mapping direction of the reproduced sound sources, for example by determining the corresponding quadrants for the function values of the aforementioned transfer functions (2) and (3) for the original stereo signal (which can be optimized by virtue of subsequent swapping of the resulting left channel and the resulting right channel, for example, see above), or the limit value S* or the deviation ϵ (for which, by way of example, it must be true that $$0\leq S^*-\epsilon\leq\max|Re\{f^*[x(t)]+g^*[y(t)]\}|\leq S^*+\epsilon\leq 1) \tag{9}$$

or the limit value U* or the deviation κ (for which, by way of example, it must be true that $$0 \leq U^* - \kappa \leq \int_{-T}^{T} |f^*[x(t)] + g^*[y(t)]|dt \leq U^* + \kappa), \tag{10}$$

all for determining or optimizing the mapping width of the stereo signal to be attained. In any case, the result is stereophonic mapping which is constant in respect of the FM signal.

In this case too, it is additionally possible to use prior art compression algorithms, data reduction methods or the evaluation of characteristic features, such as the minima and maxima, in order to speed up the evaluation of existing or obtained signals or signal components according to the invention.

In each embodiment and in each figure or each element, the circuits, converters, arrangements or logic elements presented can be implemented by equivalent software programs and programmed processors or DSP or FPGA solutions, for example.

LIST OF SYMBOLS USED

ϕ (Phi) Angle of incidence
α (alpha) Left fictitious opening angle
β (beta) Right fictitious opening angle
λ Attenuation for the left input signal
ρ Attenuation for the right input signal
The attenuations λ and ρ can be used to adjust the degree of correlation of the stereo signal.
Ψ Polar angle
f Radial coordinate, which describes the directional pattern of the M signal
Pα, Pβ Gain factor for α and β
Lα, Lβ Time difference for α and β
Sα Simulated left signal component of the S signal
Sβ Simulated right signal component of the S signal
x(t) Left output signal
y(t) Right output signal
f*[x(t)] Complex transfer function
g*[y(t)] Complex transfer function
a Gain factor for the definition of the admissible range of values for the sum of the transfer functions of the resulting output signals x(t), y(t)
r Degree of correlation, derived from the short-time cross correlation
R* Limit value for the loudness of the resulting output signals x(t), y(t)
Δ Deviation
S* 1st limit value for the mapping width of the resulting output signals x(t), y(t)
ϵ Deviation
U* 2nd limit value for the mapping width of the resulting output signals x(t), y(t)
κ Deviation

The invention claimed is:

1. A method for obtaining pseudo stereophonic output signals x(t) and y(t) comprising the step of:

generating the pseudo stereophonic output signals x(t) and y(t) from a mono signal on the basis of at least one parameter by generating an MS signal from the mono signal and converting the MS signal into the pseudo stereophonic output signals x(t) and y(t) using an MS matrix, wherein x(t) is the function value of the resulting left output channel at the time t, and y(t) is the function value of the resulting right output channel at the time t;

determining a criterion of the generated pseudo stereophonic output signals x(t) and y(t); and iteratively optimizing the at least one parameter until the determined criterion is within a predetermined definition range.

2. The method of claim 1, in which the at least one parameter comprises one or any combination of an angle of incidence $\phi$ being enclosed by a main axis of a microphone and a directional axis for the sound source, a directional pattern f, a simplified parameter n of the directional pattern f, a left fictitious opening angle $\alpha$ and a right fictitious opening angle $\beta$.

3. The method of claim 1, in which the level of the maximum of the resulting left channel and the resulting right channel is normalized or, equivalently, the axis length of the reference system for the pseudo-stereophonic output signals x(t) and y(t) are normalized, and the criterion is determined on the basis of the normalized pseudo stereophonic output signals x(t) and y(t).

4. The method of claim 1, in which the criterion is a degree of correlation of the pseudo-stereophonic output signals x(t) and y(t).

5. The method of claim 1, in which the criterion being within a predetermined definition range is defined by the expression $$Re^2\{f^*[x(t]+g^*[y(t)]\}*1/a^2+Im^2\{f^*[x(t)]+g^*[y(t)]\}\leq 1,$$

with a value a with $0\leq a\leq 1$ and with the complex transfer functions $$f^*[x(t)]=[x(t)/\sqrt{2}]*(-1+i)$$

$$g^*[y(t)]=[y(t)/\sqrt{2}]*(1+i).$$

6. The method of claim 1, in which the definition range is determined by the user.

7. The method of claim 1, in which the definition range is automatically determined with greater constraint for speech than for music.

8. A method for obtaining pseudo stereophonic output signals x(t) and y(t) comprising the step of:

generating the pseudo stereophonic output signals x(t) and y(t) from a mono signal on the basis of at least one parameter by generating an MS signal from the mono signal and converting the MS signal into the pseudo stereophonic output signals x(t) and y(t) using an MS matrix, wherein x(t) is the function value of the resulting left output channel at the time t, and y(t) is the function value of the resulting right output channel at the time t;

determining a criterion of the generated pseudo stereophonic output signals x(t) and y(t); and iteratively optimizing the at least one parameter until the determined criterion is within a predetermined definition range, wherein the criterion is within a predetermined definition range defined by the expression $$0 \leq R^* - \Delta \leq \int_{-T}^{T} \left| f^*[x(t)] + g^*[y(t)] \right|$$

-continued $$dt \leq \max(f^*[x_i(t)], g^*[y_i(t)]) \in \Phi \int_{-T}^{T} |f^*[x_j(t)] + g^*[y_j(t)]| dt \leq$$

$$R^* + \Delta \leq \int_{-T}^{T} a*(1/\sqrt{[1-(1-a^2)*\sin^2\arg(f^*[x(t)]+g^*[y(t)])]})dt$$

where $0\leq a\leq 1$ and the complex transfer functions are defined according to the following expressions $$f^*[x(t)]=[x(t)/\sqrt{2}]*(-1+i)$$

$$g^*[y(t)]=[y(t)/\sqrt{2}]*(1+i).$$

9. The method of claim 1, further comprising determining a mapping direction of an existing stereo signal and switching the pseudo stereophonic output signals x(t) and y(t) on the basis of the mapping direction.

10. The method of claim 1, wherein the criterion being within a predetermined definition range is defined by the expressions $$0 \leq S^* - \varepsilon \leq \max|\mathrm{Re}\{f^*[x(t)] + g^*[y(t)]\}| \leq S^* + \varepsilon \leq 1 \text{ and}$$

$$0 \leq U^* - \kappa \leq \int_{-T}^{T} |\{f^*[x(t)] + g^*[y(t)]\}| dt \leq U^* + \kappa$$

with limit values S* and U* and with deviations $\epsilon$ and $\kappa$ and the complex transfer functions $$f^*[x(t)]=[x(t)/\sqrt{2}]*(-1+i)$$

$$g^*[y(t)]=[y(t)/\sqrt{2}]*(1+i).$$

11. The method of claim 1, wherein the definition range is determined on the basis of an existing stereo signal.

12. The method of claim 1, further comprising the additional application of compression methods or data reduction methods or other selective evaluation methods, to audio signals.

13. The method of claim 1, further comprising the additional conversion of the obtained stereophonic output signals into stereo signals which are reproduced for more than two loudspeakers.

14. The method of claim 1, applied to FM stereo signals by using a main channel signal of a received FM stereo signal as an input signal.

15. An apparatus for obtaining pseudo stereophonic output signals x(t) and y(t) comprising:

a converter for generating the pseudo stereophonic output signals x(t) and y(t) from a mono signal on the basis of at least one parameter by generating an MS signal from the mono signal and converting the MS signal into the pseudo stereophonic output signals x(t) and y(t) using an MS matrix, the converter comprising the MS matrix;

a criterion section for determining a criterion of the generated pseudo stereophonic output signals x(t) and y(t);

an optimizing section for iteratively optimizing the at least one parameter until the criterion is within a predetermined definition range.

16. The apparatus of claim 15, in which the at least one parameter comprises one or any combination of an angle of incidence $\phi$ being enclosed by a main axis of a microphone and a directional axis for the sound source, a directional pattern f, a simplified parameter n of the directional pattern f, a left fictitious opening angle $\alpha$ and a right fictitious opening angle $\beta$.

17. The apparatus of claim 15, having normalization means for normalizing the level of the maximum of the pseudo stereophonic output signals x(t) and y(t) or, equivalently, for normalizing the axis length of the reference system for the pseudo stereophonic output signals x(t) and y(t), and the criterion section is configured to determining the criterion on the basis of the normalized pseudo stereophonic output signals x(t) and y(t).

18. The apparatus of claim 15, wherein the criterion is a degree of correlation of the pseudo-stereophonic output signals x(t) and y(t).

19. The apparatus of claim 15, wherein the criterion being within a predetermined definition range is defined by the expression $$|Re\{f^*[x(t)]+g^*[y(t)]\}|\leq|a^*\cos arg\{f^*[x(t)]+g^*[y(t)]\}|$$

where $0\leq a\leq 1$ and the complex transfer functions are defined according to the following expressions $$f^*[x(t)]=[x(t)/\sqrt{2}]^*(-1+i)$$

$$g^*[y(t)]=[y(t)/\sqrt{2}]^*(1+i).$$

20. The apparatus of claim 15, in which the definition range is determined by the user.

21. The apparatus of claim 15, having means for determining the definition range with greater constraint for speech than for music.

22. The apparatus of claim 15, in which the criterion being within a predetermined definition range is defined by the expression $$0 \leq R^* - \Delta \leq \int_{-T}^{T} \left| f^*[x(t)] + g^*[y(t)] \right| dt \leq \max(f^*[x_i(t)], g^*[y_i(t)]) \in \Phi \int_{-T}^{T} |f^*[x_j(t)] + g^*[y_j(t)]| dt \leq R^* + \Delta \leq \int_{-T}^{T} a*(1/\sqrt{[1-(1-a^2)*\sin^2\arg(f^*[x(t)]+g^*[y(t)])]})dt$$

where $0\leq a\leq 1$ and the complex transfer functions are defined according to the following expressions $$f^*[x(t)]=[x(t)/\sqrt{2}]^*(-1+i)$$

$$g^*[y(t)]=[y(t)/\sqrt{2}]^*(1+i).$$

23. The apparatus of claim 15, having means for determining a mapping direction of an existing stereo signal and means for switching the pseudo stereophonic output signals x(t) and y(t) on the basis of the mapping direction.

24. The apparatus of claim 15, wherein the criterion being within a predetermined definition range is defined by the expressions $$0 \leq S^* - \varepsilon \leq \max|\mathrm{Re}\{f^*[x(t)] + g^*[y(t)]\}| \leq S^* + \varepsilon \leq 1 \text{ and}$$

$$0 \leq U^* - \kappa \leq \int_{-T}^{T} |\{f^*[x(t)] + g^*[y(t)]\}| dt \leq U^* + \kappa$$

with limit values S* and U* and with deviations $\epsilon$ and $\kappa$ and the complex transfer functions $$f^*[x(t)]=[x(t)/\sqrt{2}]^*(-1+i)$$

$$g^*[y(t)]=[y(t)/\sqrt{2}]^*(1+i).$$

25. The apparatus of claim 15 having means for determining the definition range on the basis of an existing stereo signal.

26. The apparatus of claim 15, having means for compression or data reduction or other selective evaluation of audio signals.

27. The apparatus of claim 15, further comprising one or more converters for converting the obtained stereophonic output signals into stereo signals which are designed for more than two loudspeakers.

28. The apparatus of claim 15 for processing FM stereo signals by using a main channel signal of a received FM stereo signal as an input signal.

29. The apparatus of claim 15, wherein the at least one parameter for generating the pseudo-stereophonic signal x(t) and y(t) is applied before the MS matrix.

30. The method of claim 1, wherein the at least one parameter for generating the pseudo-stereophonic signal x(t) and y(t) is applied before the MS matrix.

31. The method of claim 14, wherein a subchannel signal of the received FM stereo signal is used to define the definition range.

32. The apparatus of claim 28, wherein a subchannel signal of the received FM stereo signal is used to define the definition range.

33. The apparatus of claim 15, wherein the converter is configured to generate the MS signal from the mono signal by:

generating a mid or main (M) signal, a first intermediate signal, and a second intermediate signal by delaying and amplifying the mono signal, and generating a side (S) signal by summing the first intermediate signal and the second intermediate signal.

34. The method of claim 1, wherein the MS signal is generated from the mono signal by:

generating a mid or main (M) signal, a first intermediate signal, and a second intermediate signal by delaying and amplifying the mono signal, and generating a side (S) signal by summing the first intermediate signal and the second intermediate signal.

* * * * *